US009531136B2

(12) United States Patent
Yossef

(10) Patent No.: US 9,531,136 B2
(45) Date of Patent: Dec. 27, 2016

(54) KEYSTONE JACK FOR USE IN A COMPUTING NETWORK

(71) Applicant: HCS KABLOLAMA SISTEMLERI SAN. ve TIC.A.S., Esenler/Istanbul (TR)

(72) Inventor: Shay Yossef, Moshav Maor (IL)

(73) Assignee: HCS KABLOLAMA SISTEMLERI SAN. ve TIC.A.S., Esenler/Istanbul (TR)

( * ) Notice: Subject to any disclaimer, the term of this patent is extended or adjusted under 35 U.S.C. 154(b) by 0 days.

(21) Appl. No.: 14/400,880

(22) PCT Filed: May 8, 2013

(86) PCT No.: PCT/IB2013/053703

§ 371 (c)(1),
(2) Date: Nov. 13, 2014

(87) PCT Pub. No.: WO2013/171626

PCT Pub. Date: Nov. 21, 2013

(65) Prior Publication Data

US 2015/0132975 A1 May 14, 2015

Related U.S. Application Data

(60) Provisional application No. 61/646,515, filed on May 14, 2012, provisional application No. 61/713,669, filed on Oct. 15, 2012.

(51) Int. Cl.
*H01R 24/00* (2011.01)
*H01R 13/66* (2006.01)
(Continued)

(52) U.S. Cl.
CPC ..... *H01R 13/6691* (2013.01); *H01R 13/641* (2013.01); *H01R 24/64* (2013.01);
(Continued)

(58) Field of Classification Search
CPC ... H01R 13/6658; H01R 29/00; H01R 23/025; H01R 23/005
(Continued)

(56) References Cited

U.S. PATENT DOCUMENTS 5,704,802 A 1/1998 Loudermilk
6,089,923 A * 7/2000 Phommachanh .... H05K 1/0228 439/676

(Continued)

FOREIGN PATENT DOCUMENTS

WO 03/093888 A1 11/2003
WO 2010/042593 A1 4/2010

*Primary Examiner* — Thanh Tam Le
(74) *Attorney, Agent, or Firm* — D.Kligler IP Services Ltd.

(57) ABSTRACT

Provided is a keystone jack for use as a port in a wired computing network. The keystone jack includes a housing, a plug receptacle within the housing configured to receive a plug connector therein, a termination portion of the housing for connecting a network cable thereto, a first circuit disposed between the plug receptacle and the termination portion, a plurality of conductive terminals disposed within the plug receptacle and configured for defining together with the first circuit and the termination portion a communication channel for electrically communicating between the plug receptacle and the termination portion, and an interfacing unit being in electric communication with the first circuit and configured for interfacing with a detachably attachable supplementary electric unit to provide electrical communication thereof with said at least a portion of the communication channel.

19 Claims, 17 Drawing Sheets

(51) Int. Cl.

| | |
|---|---|
| ***H01R 24/64*** | (2011.01) |
| ***H01R 27/02*** | (2006.01) |
| ***H01R 13/641*** | (2006.01) |
| ***H01R 43/20*** | (2006.01) |
| *H01R 4/24* | (2006.01) |

(52) U.S. Cl.
CPC ..... *H01R 27/02* (2013.01); *H01R 43/205* (2013.01); *H01R 4/2416* (2013.01); *H01R 13/6658* (2013.01); *Y10T 29/49204* (2015.01)

(58) Field of Classification Search
USPC ..... 439/76.1, 189, 676, 941
See application file for complete search history.

(56) References Cited

U.S. PATENT DOCUMENTS

| | | | | |
|---|---|---|---|---|
| 6,561,842 | B1 | 5/2003 | Watanabe et al. | |
| 6,814,624 | B2 * | 11/2004 | Clark | H01R 13/506 439/676 |
| 7,789,713 | B2 * | 9/2010 | Slepov | H01R 43/205 439/676 |
| 7,857,667 | B1 * | 12/2010 | Wang | H01R 13/6466 439/676 |
| 7,914,345 | B2 * | 3/2011 | Bopp | H01R 13/6467 439/676 |
| 7,914,346 | B2 * | 3/2011 | Pharney | H01R 13/6658 439/676 |
| 7,980,882 | B2 * | 7/2011 | Hetzer | H01R 24/64 439/404 |
| 8,070,531 | B1 * | 12/2011 | Ku | H01R 4/242 439/676 |
| 8,202,128 | B2 * | 6/2012 | Hammond, Jr. | H05K 1/0228 439/676 |
| 8,480,439 | B1 * | 7/2013 | Chen | H01R 13/506 439/620.11 |
| 8,562,358 | B2 * | 10/2013 | Panella | H04L 41/12 439/49 |
| 2004/0102097 | A1 | 5/2004 | Clark et al. | |
| 2011/0256767 | A1 | 10/2011 | Malstrom et al. | |

* cited by examiner

KEYSTONE JACK FOR USE IN A COMPUTING NETWORK

FIELD OF THE DISCLOSED SUBJECT MATTER

The present disclosed subject matter is concerned with cabling systems, and more specifically with a keystone jack for use in a wired computing network.

BACKGROUND OF THE DISCLOSED SUBJECT MATTER

A keystone jack is a female connector used in data communications, particularly local area networks (LANs). It is usually mounted in a wall plate, a patch panel, or any other network element in which a port for a plug connector is used. The plug connector (e.g., a keystone plug) is a matching male connector that is usually attached to the end of a patch cable or a patch cord, and that is configured to be received within the keystone jack and electrically connected thereto. On principal advantage of such plug connectors is their versatility.

A standard keystone jack is structured such that its one side has a female connector for receiving therein the plug connector of the patch cord, and the other side of the keystone jack has an IDC-type (insulation displacement contact) termination portion for connecting a network cable. A special tool is usually used for connecting the wires of the network cable to the IDC-type termination portion. With the help of this tool each cable conductor is fitted between studs of the IDC termination portion.

A patch panel is a panel of network ports contained together, usually within a telecommunications closet, connecting incoming and outgoing lines of a LAN or other communication, electronic or electrical system. The ports of the patch panel are provided by a plurality of keystone jacks horizontally arranged in line therein. In a LAN, the patch panel and its keystone jacks connect the network's computers and devices to each other and to the outside lines that enable the LAN to connect to the Internet or another WAN by patch cords. The patch panel allows circuits to be arranged and rearranged by plugging and unplugging the patch cords.

Some known keystone jacks include electrical elements such as integrated circuits, which operate together with a network scanner for monitoring the keystone jacks and their connectivity and patching to other network elements and components. One example of these keystone jacks is disclosed in WO 2010/042593. The keystone jacks according to this reference include circuit boards on which electrical elements such as, integrated circuits and/or processors are incorporated for monitoring the status of the network elements. These electrical elements are permanently disposed on the circuit boards of the keystone jack, and cannot be easily replaced with other electric elements that represent a different functionality. For replacing the electric logic according to which these elements operate with another electric logic, the whole keystone jack has to be replaced with another keystone jack. This replacement usually involves disconnection wires of a network cable from the rear portion of the keystone jack, and connection of these wire to the replaced keystone jack.

SUMMARY OF THE DISCLOSED SUBJECT MATTER

The presently disclosed subject matter, in accordance with one aspect, provides a keystone jack for use as a port in a wired computing network for interconnecting elements of the network. The keystone jack comprises: a housing; a plug receptacle within the housing configured to receive a plug connector therein; a termination portion of the housing for connecting a network cable thereto; a first circuit disposed between the plug receptacle and the termination portion; a plurality of conductive terminals disposed within the plug receptacle and configured for defining together with the first circuit a communication channel for electrically communicating between the plug receptacle and the termination portion; and an interfacing unit being in electric communication with the first circuit and configured for interfacing with a detachably attachable supplementary electric unit to provide electrical communication thereof with said at least a portion of the communication channel.

The term 'network element' refers hereinafter, for example, to one of the following elements: a server, a switch, a patch panel, a cross-connect panel, a work area outlet, a keystone jack, a port, and an end-user device.

The term 'end-user device' refers hereinafter to any device that can be connected to a work area outlet and can be, for example, a personal computer, a telephone, a printer, and a monitor.

The term 'work area outlet' refers hereinafter to an outlet or a port that can be found in locations in which a network user has an end-user device to be connected to the computed network.

The term 'circuit' refers hereinafter to a printed circuit board or any other structure with or without electric elements mounted thereon.

The term 'communication channel' refers to one or more twisted pairs in which electric signals pass via an electric circuit.

The term 'a portion of a communication channel' refers to at least one twisted pair selected from the twisted pairs of the communication channel.

The term 'electric element' refers hereinafter to an electric component mountable on a circuit so as to perform a particular electric function. The electric element can be, for example, one of the following: a diode, a transistor, an integrated circuit, an optoelectronic device (e.g., an LED device), a display device, an electric vacuum tube (e.g., a diode, an optical detector), a discharge device, a power source (e.g., a battery), a resistor, a capacitor, a magnetic device (e.g., a transformer, an inductor, a motor), a transducer, a sensor, an antenna, a piezoelectric device, a connector, a switch, an a protection device.

The supplementary electric unit can comprise at least one second circuit with at least one electric element mounted thereon configured to enrich the electric capabilities of said at least a portion of the communication channel by electrically communication therewith. The at least one electric element can be at least one integrated circuit. The term 'enrich electric capabilities' refers hereinafter to extension of electric functionality that said at least a portion of the communication channel provides without interfacing with the supplementary electric unit.

The electric element of the second circuit can be configured to inject and sense signals relating to signal transition between the communication channel and at least one another network element.

The electric element can be further configured to communicate with a network scanner.

The supplementary electric unit that is attachable to the keystone jack of the presently disclosed subject matter, can be implemented for enriching the electric capabilities of said at least a portion of the communication channel by performing various functions such as: monitoring of the keystone jack, and the network elements connected thereto, and many other functions, as it is detailed below. The supplementary electric unit can be configured for electrically communicating with the first circuit, and to perform processing of the signals passing therein. As part of this signal processing, the supplementary electric unit can be configured perform the following operations, such as: receive signals relating to operation of the keystone jack, to communicate with a network scanner, analyze patching between the keystone jack and ports of one or more other patch panels or work area outlets, monitor electric signals in the communication channel, verify connectivity between the plug connector with a network element connected thereto and the first circuit, verify connectivity between the network cable with a network element connected thereto and the first circuit, monitor working status of at least one network element connected to the first circuit, and identify the keystone jack.

For performing the above and other operations, the keystone jack and the supplementary electric unit mounted thereto can communicate with a patch panel, a scanner, a server, or any other dedicated network element connected to the wired computing network.

The ability to mount a supplementary electric unit to an existing keystone jack can improve the abilities of the keystone jack and enrich its electric capabilites, by, for example, converting a regular keystone jack, i.e., a "stupid" keystone jack that just connects a patch cord to a network cable and transfers electric signals therebetween, to a "smart" keystone jack that, for example, allows monitoring the keystone jack and the electric signals passing therethrough by one of the above network elements (preferably, a network scanner) to which the keystone jack is connected.

The supplementary electric unit can be a termination unit and the electric element is constituted by an electronically sensible element. The supplementary electric unit can further provide a sensing circuit that can be integrated into a work area outlet of the network that is corresponding to the keystone jack (e.g., when the work area outlet is constituted by the keystone jack itself, or when the keystone jack is mounted in a patch panel which is connected to the work area outlet by a network cable), such that when an end-user device is connected to or disconnected from the network, this can be measured by the sensing circuit of the supplementary electric unit, for example, as a result of a change in the impedance provided electric elements of the sensing circuit.

The wired computing network in which the keystone jack of the presently disclosed subject matter can be used, can include a plurality of network elements located at different locations of the network. The network elements are interconnected therebetween via network cables.

The keystone jack of presently disclosed subject matter can be integrated in a network element such as a patch panel, a cross-connect panel, or a switch. Alternatively, the keystone jack of the presently disclosed subject matter can be used to provide a work area outlet or a port at a specific location (e.g., a meeting room, an office) where a device may be installed by connection thereto.

The keystone jack of the presently disclosed subject matter can be, for example, a RJ-45-style keystone jack.

The supplementary electric unit can further comprise at least one indicator disposed on the at least one second circuit for selectively indicating data related to an output of the at least one electronic element. The indicator can be configured to indicate proper functioning of a network element connected to the first circuit of the keystone jack. The indicator can be a LED.

The at least one second circuit can be constituted by a second circuit and a third circuit in communication with one another and spaced apart.

The interfacing unit can comprise a plurality of pin terminals associated with different portions of the communication channel and configured for connecting within corresponding receptacles of the supplementary electric unit, thereby establishing electric communication between the corresponding portions of the communication channel and the supplementary electric unit.

The keystone jack can further comprise an indicating switch which is configured for indicating plugging of the plug connector within the plug receptacle. The indicating switch can be in electric communication with the first circuit.

The indicating switch can be a mechanical switch having a movable element and a static element. The mechanical switch can be operatable so that when the plug connector is received within the plug receptacle, the movable element changes its position relative to the static element, changing thereby the electric connectivity to indicate regarding the plugging of the plug connector within the plug receptacle.

The plurality of pin terminals of the interfacing unit can include a first group of pin terminals being in electric communication with corresponding portions of the communication channel, and a second group of pin terminals in electric communication with the indicating switch.

The second group of pin terminals can include a first pin being in electric communication with the movable element and a second pin in electric communication with the static element.

Each one of the pin terminals of the second group can be in electric communication with its corresponding pin terminal of the first group.

Those pin terminals of the first group that are electrically connected to the corresponding pin terminals of the second group, can be configured for electrically communicating with the supplementary electric unit for measuring the impedance or detecting a short circuit therebetween so as to obtain indication regarding the plugging of the plug connector within the plug receptacle.

The electric communication between the pin terminals of the first group and the pin terminals of the second group can be provided within the first circuit.

The electric communication between the pin terminals of the first group and the pin terminals of the second group can be provided within the supplementary electric unit.

The pin terminals of the first group can be electrically insulated from those of the second group.

The pin terminals of the second group can be configured for electrically communicating with said supplementary electric unit for measuring the impedance or detecting a short circuit therebetween, so as to obtain indication regarding the plugging of the plug connector within the plug receptacle.

The interfacing unit can further comprise an interfacing unit circuit on which the pin terminals are disposed, and which is configured for electrically communicating with the first circuit.

The first circuit can have at least one electric element disposed thereon and in electric communication with the communication channel.

The electric element of the first circuit can be a transformer.

The second circuit can be configured to electrically communicate with the transformer to inject and sense signals relating to signal transition between the communication channel and at least one another network element.

The interfacing between the interfacing unit and the supplementary electric unit is configured to facilitate exchanging one supplementary electric unit with another supplementary electric unit whilst maintaining connection of the network cable to the termination portion.

The interfacing unit can be separate and distinct from the termination portion.

The presently disclosed subject matter, in accordance with another aspect, provides a supplementary electric unit configured to be interfaced with and attached to a keystone jack according to the presently disclosed subject matter.

The presently disclosed subject matter, in accordance with another aspect, provides a patch panel. The patch panel comprises:

a. a plurality of keystone jacks, each comprising: a housing; a plug receptacle within the housing configured to receive a plug connector therein; a termination portion of the housing for connecting a network cable thereto; a first circuit disposed between the plug receptacle and the termination portion; a plurality of conductive terminals disposed within the plug receptacle and configured for defining together with the first circuit a communication channel for electrically communicating between the plug receptacle and the termination portion; and an interfacing unit being in electric communication with at least a portion of the communication channel; and b. at least one supplementary electric unit being interfaced and in electric communication with the corresponding interfacing units of the keystone jacks; the at least one supplementary electric unit being configured for electrically communicating with the corresponding communication channels of the keystone jacks.

The presently disclosed subject matter, in accordance with another aspect, provides a method for retrofitting a wired computing network. The method comprises:

providing a keystone jack comprising: a housing; a plug receptacle within the housing configured to receive a plug connector therein; a termination portion of the housing for connecting a network cable thereto; a first circuit disposed between the plug receptacle and the termination portion; a plurality of conductive terminals disposed within the plug receptacle and configured for defining together with the first circuit a communication channel for electrically communicating between the plug receptacle and the termination portion; and an interfacing unit being in electric communication with the at least a portion of the communication channel and interfaced with a detachably attachable supplementary electric unit; the supplementary electric unit is configured for electrically communicating with at least a portion of the communication channel; and replacing the supplementary electric unit with the another supplementary electric unit whilst maintaining connection of the network cable to the termination portion.

The keystone jack of the presently disclosed subject matter and the method for maintain a computer network in the keystone jack is installed provides flexibility of replacing one supplementary electric unit with another supplementary electric unit without disconnecting the wires of the network cable connected to the keystone jack.

The above step of replacing can be performed by detaching the supplementary electric unit from the interfacing unit and attaching the another supplementary electric unit to the interfacing unit instead of the supplementary electric unit.

Each of the supplementary electric units can comprise at least one second circuit with at least one electric element mounted thereon, and the step of replacing can be performed for exchanging an electronic logic being dictated by the second circuit and the electric element of the supplementary electric unit with another electronic logic being dictated by the second circuit and the electric element of the another supplementary electric unit.

The step of replacing can be performed to exchanging a damaged supplementary electric unit with another working supplementary electric unit.

The presently disclosed subject matter, in accordance with another aspect, provides a method for using a keystone jack in a wired computing network. The method comprises:

obtaining a keystone jack comprising: a housing; a plug receptacle within the housing; a termination portion of the housing; a first circuit disposed between the plug receptacle and the termination portion; a plurality of conductive terminals disposed within the plug receptacle and configured for defining together with the first circuit a communication channel for electrically communicating between the plug receptacle and the termination portion; and an interfacing unit being in electric communication with the first circuit;

inserting a plug connector within the plug receptacle;

connecting a network cable to the termination portion;

attaching a detachably attachable supplementary electric unit to the interfacing unit, thereby establishing electric communicating between the supplementary electric unit and the first circuit.

The method can include a step of providing a keystone jack having an indicating switch. The method can further comprise a step of indicating plugging of the plug connector within the plug receptacle by the indicating switch by electrically analyzing the indicating switch.

BRIEF DESCRIPTION OF THE DRAWINGS

In order to understand the disclosed subject matter and to see how it may be carried out in practice, embodiments will now be described, by way of non-limiting examples only, with reference to the accompanying drawings, in which.

DETAILED DESCRIPTION OF EMBODIMENTS

Figure 1A:
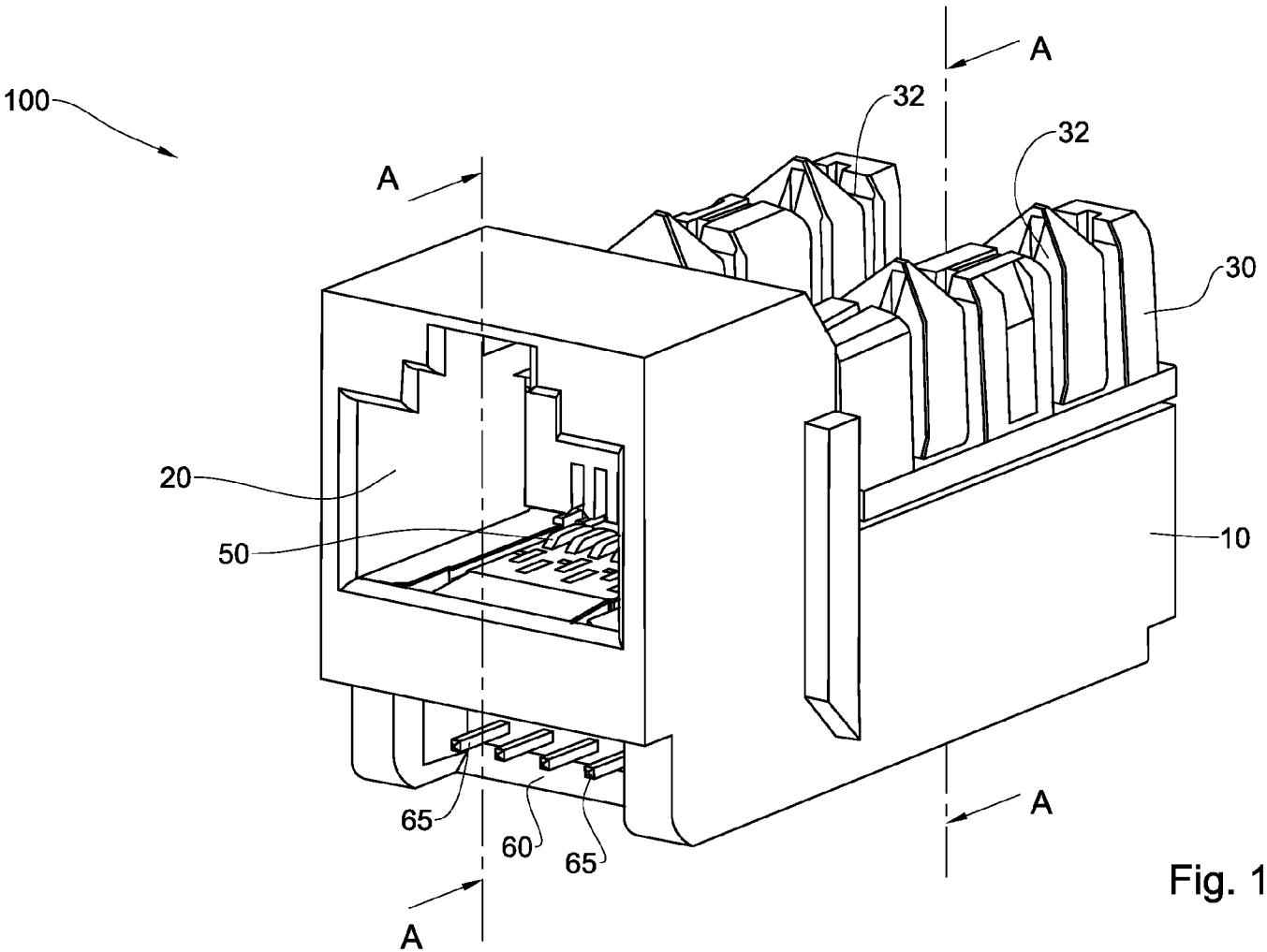
FIG. 1A is a schematic perspective view of a keystone jack according to one example of the presently disclosed subject matter.
Figure 1B:
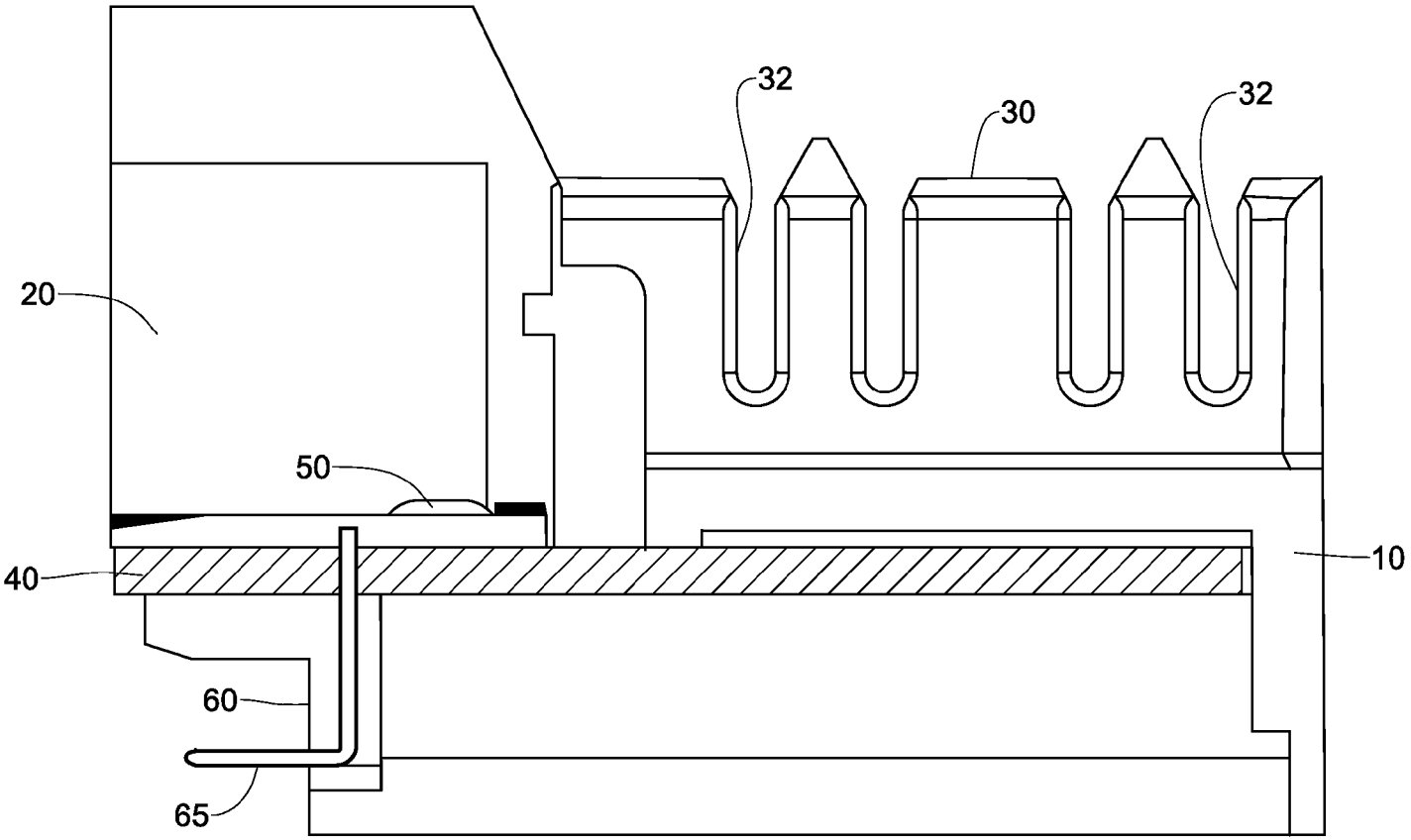
FIG. 1B is a schematic cross-sectional view of the keystone jack according to FIG. 1A, taken along plane AA of FIG. 1A.

Attention is first directed to FIGS. 1A and 1B of the drawings which schematically illustrates a keystone jack 100 according to one example of the presently disclosed subject matter. The keystone jack 100 is configured to be used as a port in a wired computing network (not shown). The keystone jack 100 comprises: a housing 10; a plug receptacle 20 formed within the housing 10 and configured to receive therein a plug connector (not shown) of a patch cord; and a termination portion 30 of the housing 10 for connecting wires of a network cable (not shown) thereto. The keystone jack 100 further comprises a first circuit 40 (shown in FIG. 1B) disposed between the plug receptacle 20 and the termination portion 30, and a plurality of conductive terminals 50 disposed within the plug receptacle 20 and configured for defining together with the first circuit 40 a communication channel for electrically communicating between the plug receptacle 20 and the termination portion 30. The conductive terminals 50 are connected to orifices formed within the first circuit 40, and the termination portion 30 has a plurality of conductive elements (not shown) which are interfaced with corresponding portions of the first circuit 40 for electrically connecting with the conductive terminals 50 via the first circuit 40. The conductive terminals 50 of this example are eight terminals arranged to provide four different signal pairs.

The termination portion 30 includes a plurality of projecting studs 32, which incorporate conductive insulation displacement technology ("IDT") terminals. The network cable that is connectable to the IDT terminals of the projecting studs 32 includes a plurality of individual wires. This cable can be of an Ethernet standard, containing eight conductive wires that are arranged as twisted pairs, i.e. four pairs of differential signal wires. This cable can lead to a work area outlet or any other network element, component, or port. The individual wires of this cable can be terminated to the IDT terminals by using a termination tool (not shown) that is engaged with the termination portion 30 and then pressed down to force the individual wires to enter into slots disposed between the projecting studs 32 in which the IDT terminals are held.

When the plug connector is received within the plug receptacle 20, and the network cable is connected to the termination portion 30, a communication channel is established between plug connector and the network cable via the first circuit 40. According to the example of FIGS. 1A and 1B, the first circuit 40 is configured only to transfer signals from the plug connector to the network cable, without performing any processing, monitoring or calculations with respect to these signals. According to other examples, the first circuit can include electrical elements which may be configured for performing various monitoring and signal processing operations.

The keystone jack 100 additionally comprises an interfacing unit 60 which is in electric communication with the first circuit 40 and configured for interfacing with a detachably attachable supplementary electric unit (shown in FIGS. 2A and 2B) to provide electrical communication thereof with said at least a portion of the communication channel, and to perform processing of the signals passing therein. As part of this signal processing, the supplementary electric unit can be configured to perform by itself, or in conjunction with a network scanner, or another network element, at least one of the following operations: receive signals relating to operation of the keystone jack 100, to communicate with a network scanner, analyze patching between the keystone jack 100 and ports of one or more other patch panels or work area outlets, monitor electric signals in the communication channel, verify connectivity between the plug connector with a network element connected thereto and the first circuit 40, verify connectivity between the network cable with a network element connected thereto and the first circuit 40, monitor working status of at least one network element connected to the first circuit, and identify the keystone jack 100. According to the present example, the interfacing unit 60 is separate and distinct from the termination portion 30. According to other examples, the supplementary electric unit can be configured to perform by itself, or in conjunction with a network scanner, or another network element, at least one of the following operations: identify the location of keystone jacks in a wiring network; verify the normality of each wiring branch of the network and the associate keystone jacks; facilitate a controlled installation of a new system (e.g. computer net) on its wiring network; avoid antenna affect (of open-end wiring receiving and inducting Radio-Frequency interference) in vacant network branches; protect vacant keystone jacks against harms.

According to different examples, the keystone jack 100 can be used as a port of the following network elements: a patch panel, a cross connect panel, a network switch, and a work area outlet.

Figure 2A:
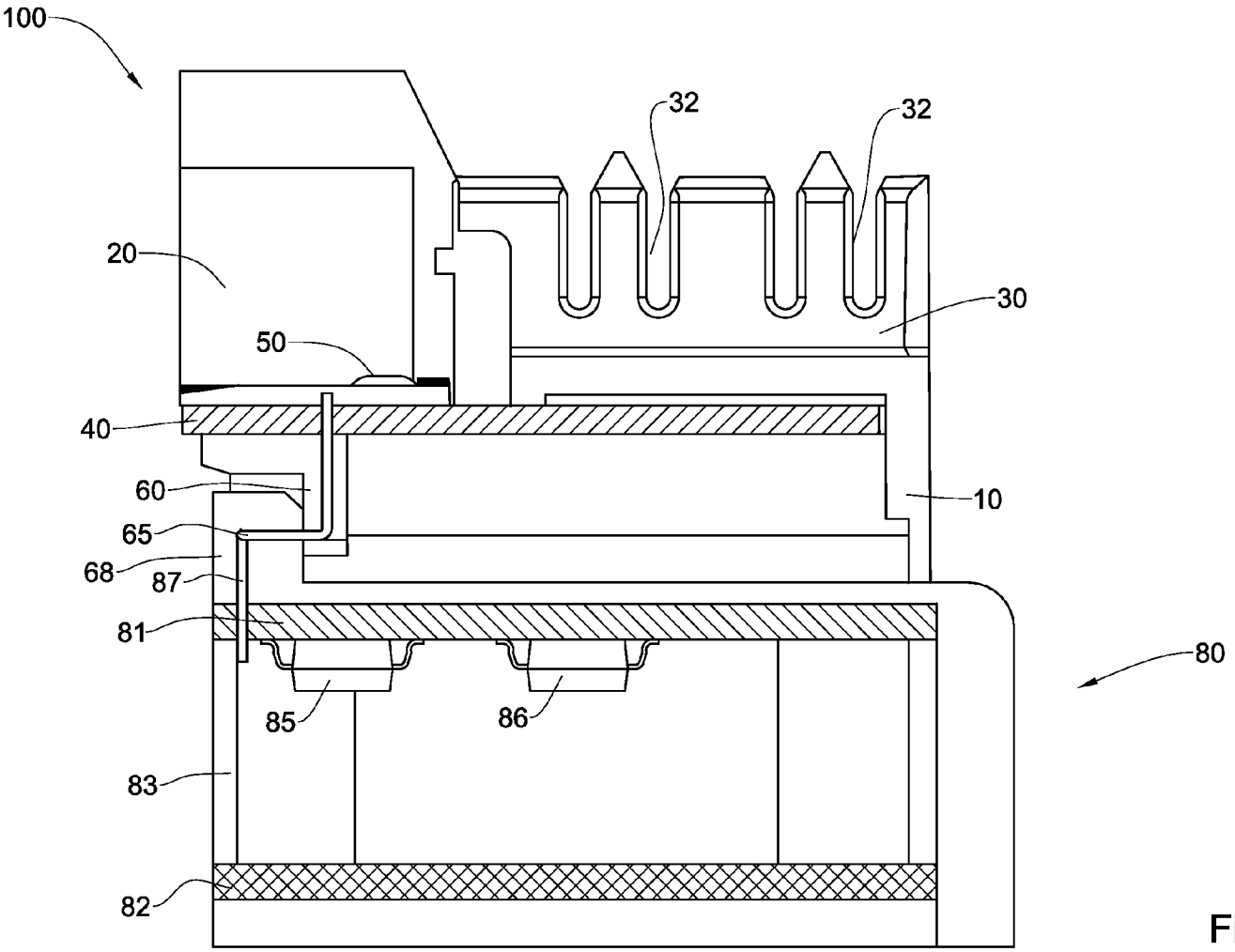
FIG. 2A is a schematic illustration of the keystone jack of FIG. 1B with one example of a schematic cross-sectional view of a supplementary electric unit being interfaced therewith.

Reference is now made to FIG. 2A, which schematically illustrates one example of a supplementary electric unit 80 mounted to the keystone jack 100. The supplementary electric unit 80 comprises connecting pins 87, a second circuit 81 and a third circuit 82 with a plurality of electric elements mounted thereon. The second circuit 81 and the third circuit 82 are in electric communication with one another via connectors 83 and spaced apart from each other.

The interfacing unit 60 of the keystone jack 100 has a plurality of pin terminals 65 that are electrically connected to the first circuit 40. The pin terminals 65 are associated with different portions of the communication channel and configured to be received within corresponding receptacles disposed in a connecting unit 68 of the supplementary electric unit 80 for establishing electric communication between at least a portion of the communication channel of the first circuit 40 and the supplementary electric unit. This electric communication is configured to enrich the electric capabilities of at least a portion of the communication channel by electrically communication therewith. The enrichment of the electric capabilities is provided by the electric functions that the electric elements of the supplementary electric unit 80 are configured to perform.

The second circuit 81 is in electric communication with the connecting pins 87 which is configured to contact the pin terminals 65, so that electric communication is established between the first, the second and the third circuits 40, 81, and 82. The electric elements which are mounted to the second and the third circuits 81 and 82, can be for example, integrated circuits 85 and 86. According to different examples, the integrated circuits can be one of the following: a controller, a multiplexer, a logic device, a processor, and any combination thereof.

Figure 2B:
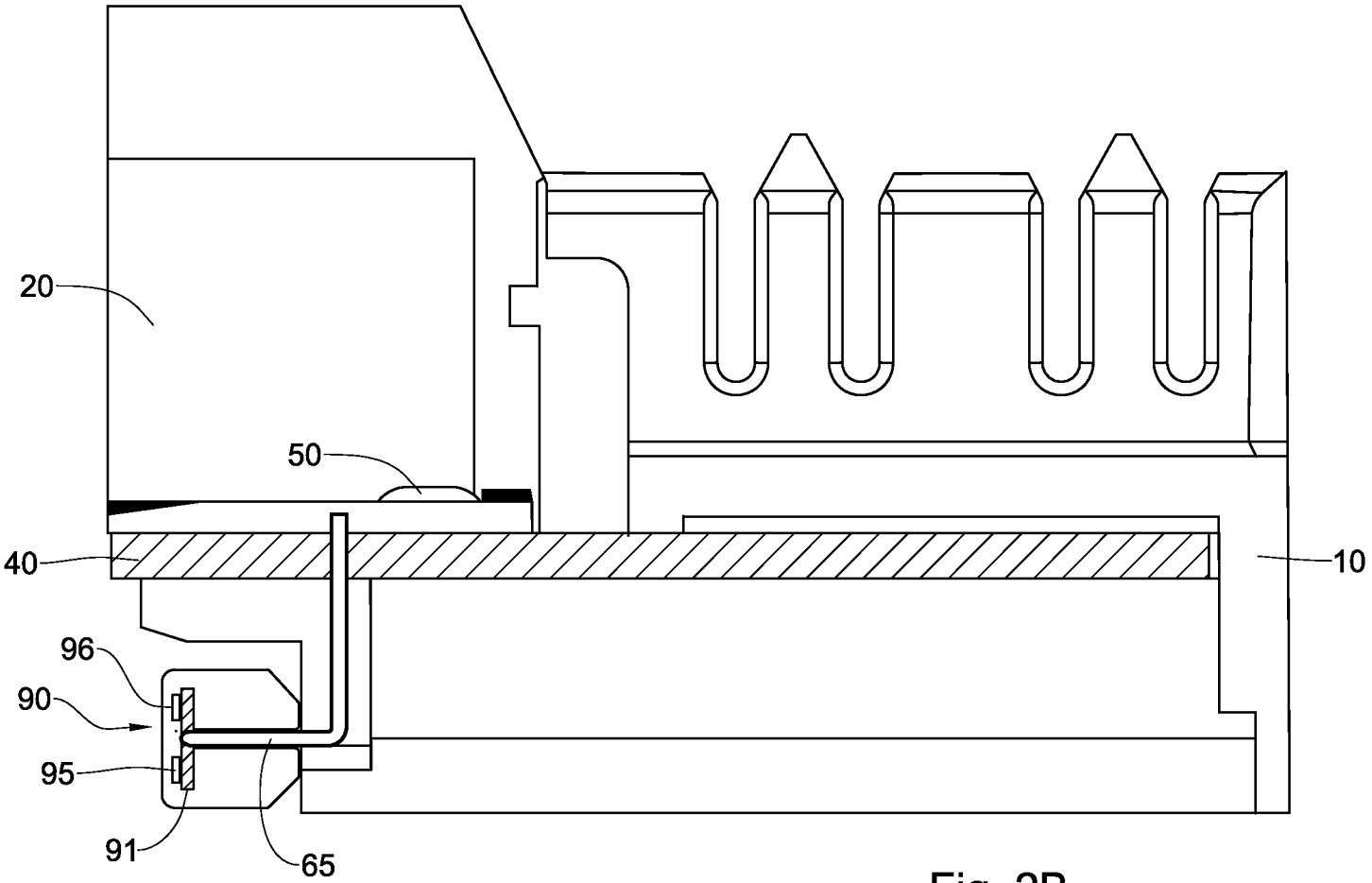
FIG. 2B is a schematic illustration of the keystone jack of FIG. 1B with one example of a schematic cross-sectional view of a supplementary electric unit in form of a termination unit being interfaced therewith.

Reference is now made to FIG. 2B, which schematically illustrates another example of a supplementary electric unit 90 mounted to the keystone jack 100. According to this example, the supplementary electric unit 90 is a termination unit. The supplementary electric unit 90 includes a second circuit 91, and the electric element mounted on the second circuit 91 is constituted by electronically sensible elements, which according to this example are resistors 95 and 96. The resistors 95 and 96 are presented in FIG. 2B for illustration purposes only, and the second circuit 91 can include more resistors mounted thereon.

According to other examples, the electronically sensible element can be selected from the group consisting of: a resistor, a capacitor, an inductor, an integrated circuit, and any combination thereof.

The termination unit 90 of the presently disclosed subject matter can be used for naming and identifying wiring outlets, for verifying the normality of the wiring, and for avoiding antenna effect. This can be provided by the resistors of the second circuit 91 which code a particular binary code according to particular combination thereof. When the supplementary electric unit 90 is mounted to the keystone jack 100, the particular binary code is remotely recognized through the wiring to which the keystone jack 100 is connected, by sensing the resistors and the continuity of the wiring and the absence of short circuits which are verified by measuring the resistance of the resistors. Each combination of the resistors represents a different binary code (i.e. for each connector contact: resistance presence means "1", resistance absence means "0"). The predetermination of the unique code for each terminator unit can be made either permanently during the manufacturing procedure, or by providing the terminator unit with resistance element for each contact, and with respective switches allowing the resistance elements to be switched on (for connecting a particular resistance) or switched off (for disconnecting a particular resistance), such that a known resistance is recognizable.

The termination unit of the presently disclosed subject matter can be based on operation principle of the termination unit disclosed in U.S. Pat. No. 6,590,374, the full content of which is incorporated herein by reference.

Figure 3A:
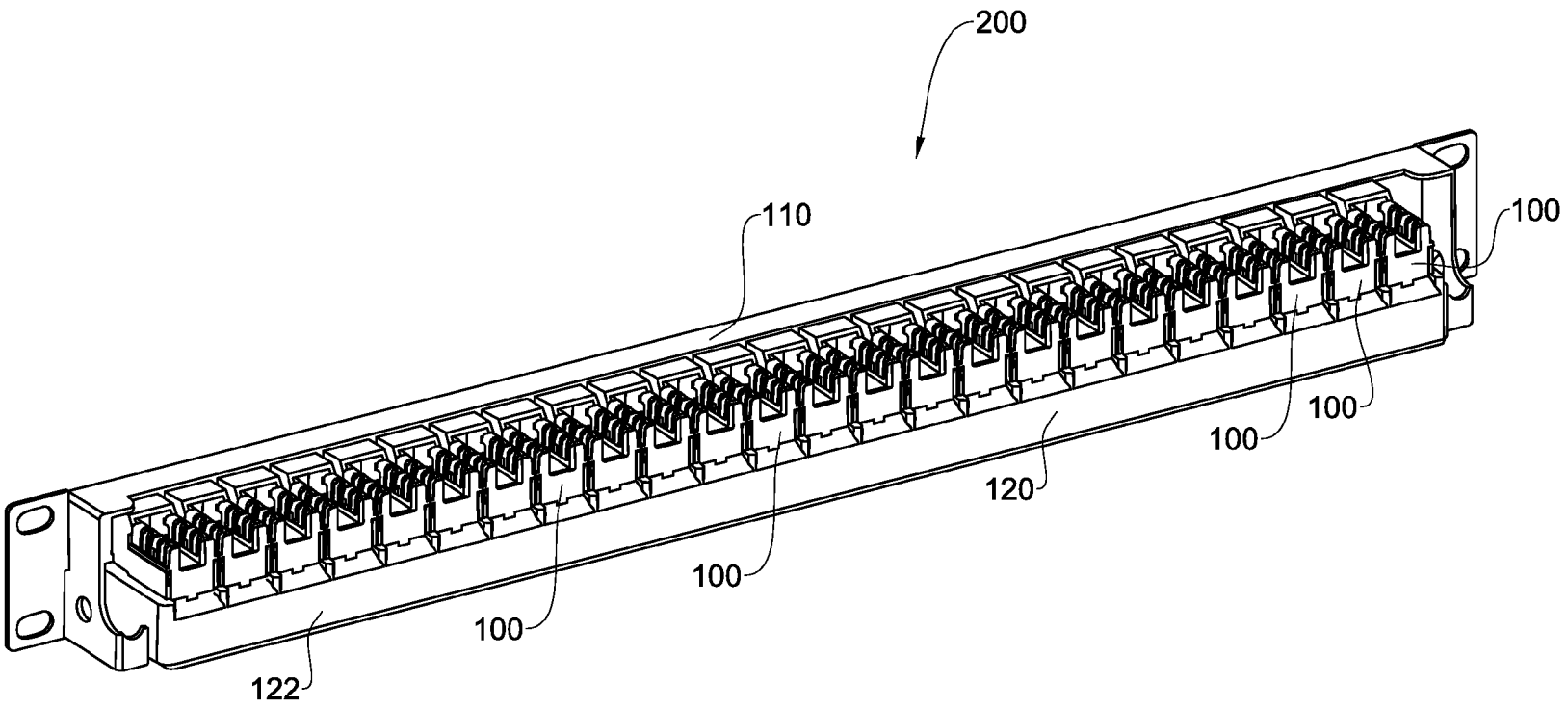
FIG. 3A is a schematic perspective rear view of a patch panel with a plurality of keystone jacks according to FIGS. 1A and 1B.
Figure 3B:
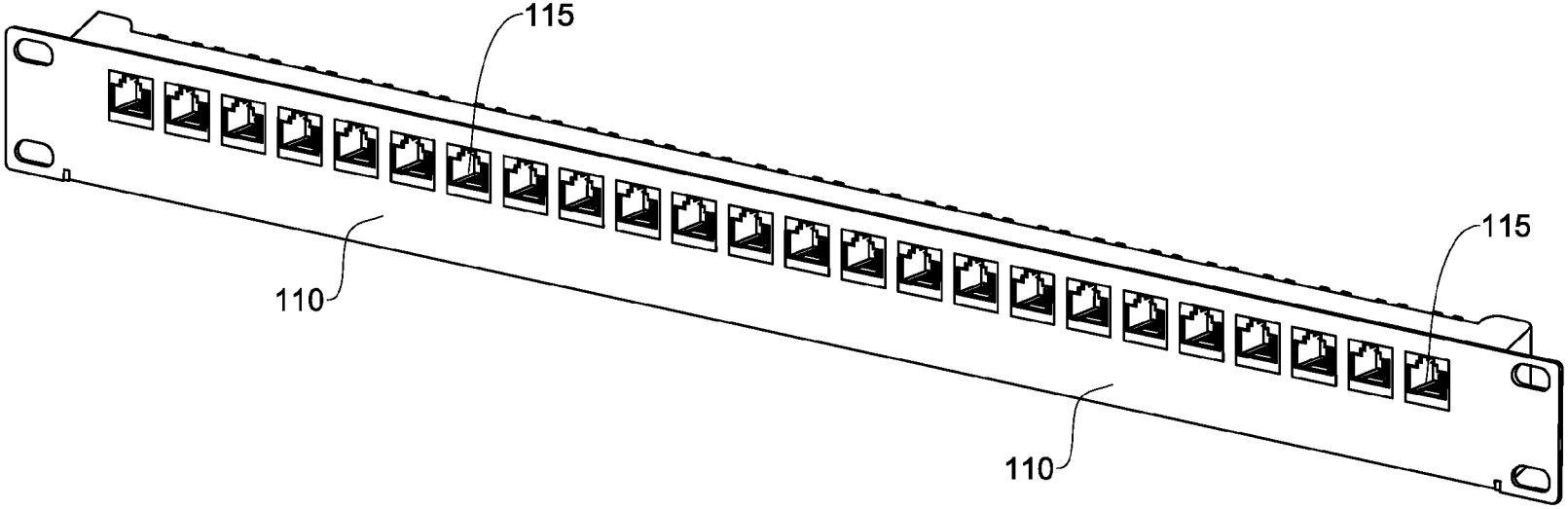
FIG. 3B is a schematic perspective front view of portion of the patch panel according to FIG. 3A.

Attention is now directed to FIGS. 3A, 3B, 4A and 4B of the drawings which schematically illustrates a patch panel 200 according to one example of the presently disclosed subject matter. The patch panel 200 can be mounted in a rack with other such panels within a wiring closet. This panel has a panel housing 110 with a plurality of individual ports 115 (shown in FIG. 3B) into which plug connectors of the patch cords may be inserted for connecting thereto the network elements, or other network components. FIG. 3A illustrates the patch panel 200 in a rear perspective view thereof, and FIG. 3B illustrates the panel housing 110 of patch panel 200 in a front perspective view thereof.

As shown in FIG. 3A, the patch panel 200 includes a plurality of keystone jacks 100 (described in a detailed manner above) proximal to each other in a side-by-side order and aligned with the ports 115. The keystone jacks 100 of this figure are mounted on one supplementary electric unit 120 having a housing 122 that incorporates second and third circuits 130 and 132 (shown in FIGS. 4A and 4B) that are electrically connected to each other. The supplementary electric unit 120 and the electric elements mounted on the second and third circuits 130 and 132 are configured to perform operations which are similar to those of the supplementary electric unit 80, but instead of connecting to one keystone jack 100, the supplementary electric unit 120 can be interfaced simultaneously with a plurality of keystone jacks 100.

Figure 4A:
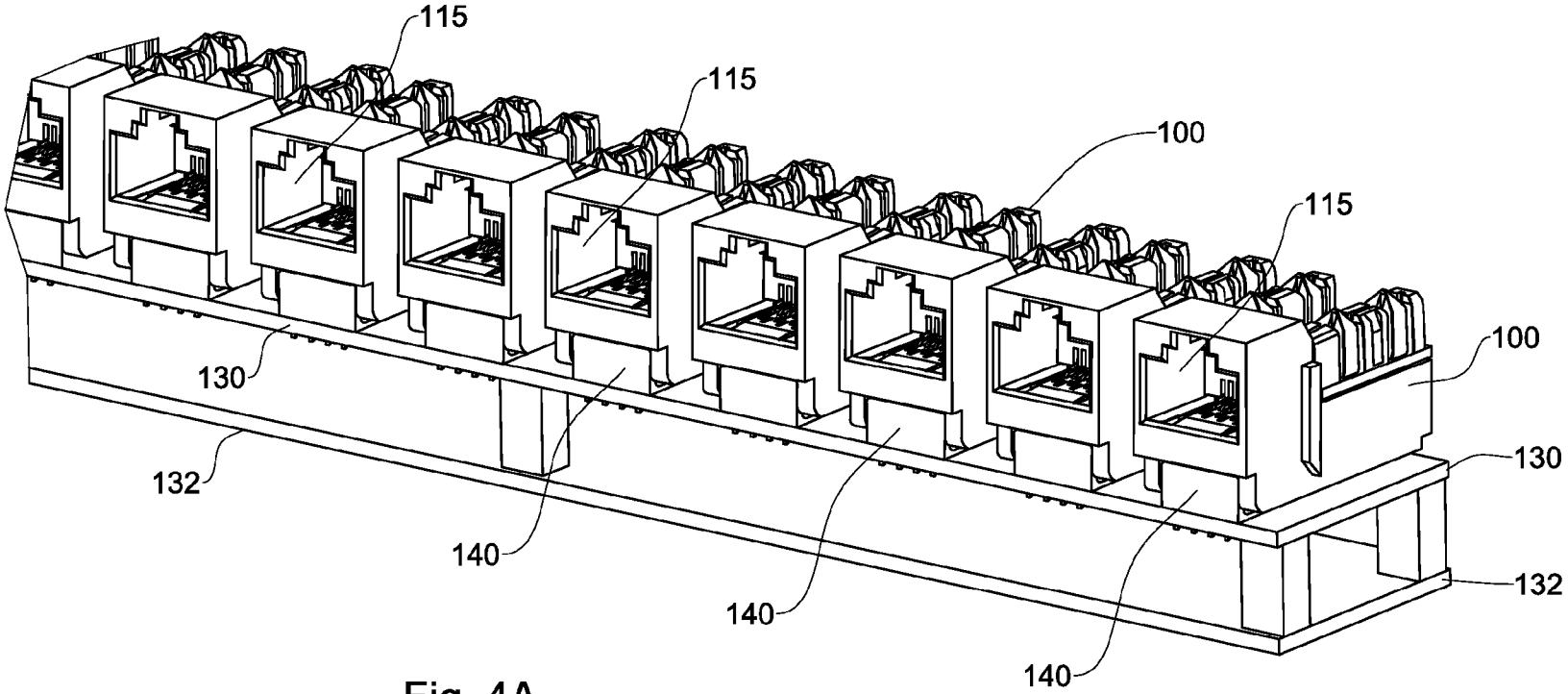
FIGS. 4A and 4B are schematic perspective front view of a plurality of keystone jacks of FIGS. 1A and 1B being interfaced with a supplementary electric unit according to one example of the presently disclosed subject matter.
Figure 4B:
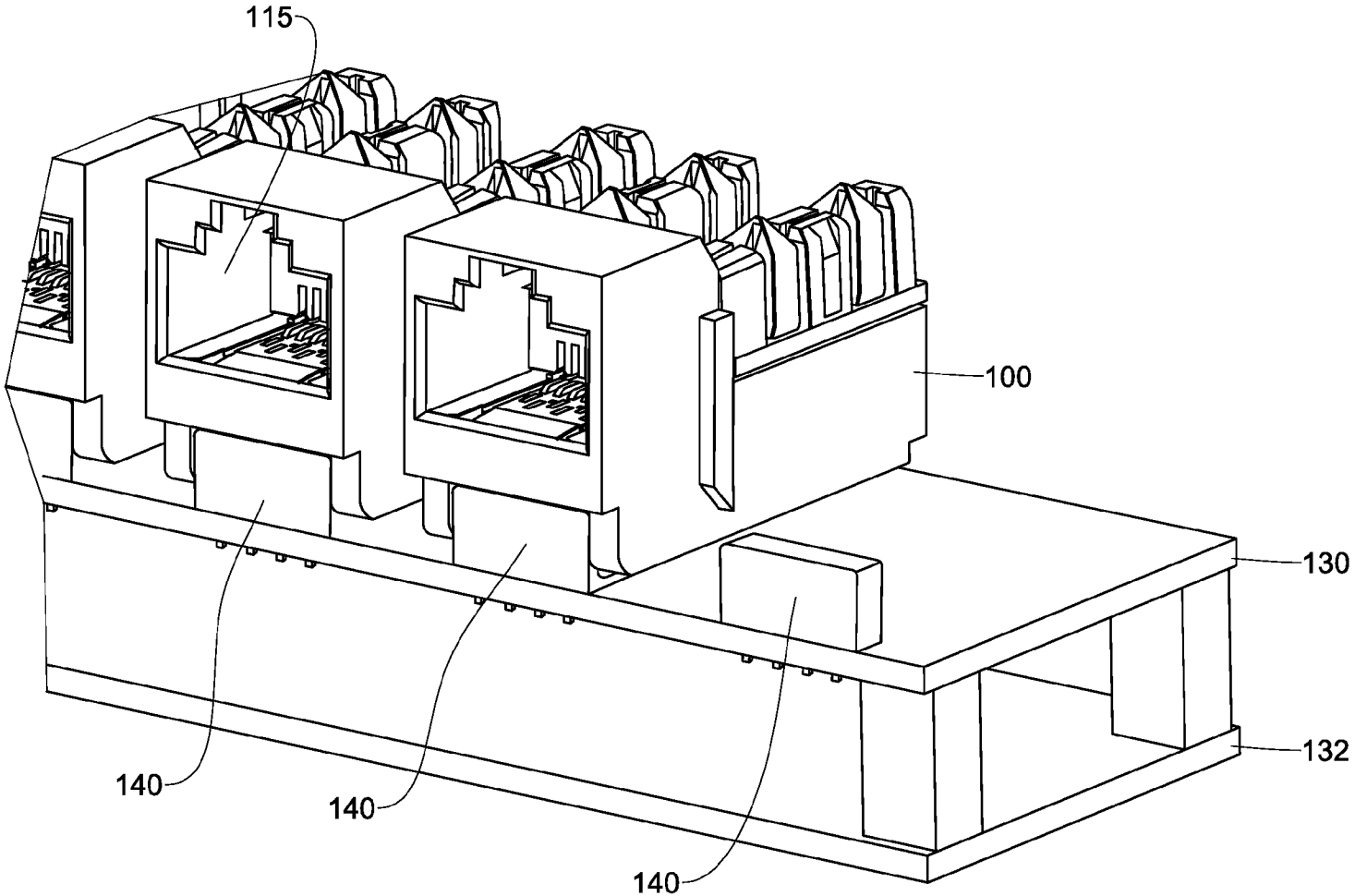

FIG. 4A is a schematic illustration of the supplementary electric unit 120 with the housing 122 removed therefrom. In this figure, the keystone jacks 100 are mounted on and electrically connected to corresponding connecting units 140 of the supplementary electric unit 120, so that an electric communication is established between the first circuits 40 of the keystone jacks 100 and second and third circuits 130 and 132 of the supplementary electric unit 120. FIG. 4B is an enlarged schematic illustration of the supplementary electric unit 120 of FIG. 4A with one missing keystone jack 100.

The supplementary electric unit 120 can be connected to a network scanner (not shown) which communicates with the second and the third circuits and the electric elements mounted thereon, for monitoring the working status of the keystone jacks 100 or connectivity of the keystone jacks 100 to other network elements or components. The network scanner can monitor devices, and ports connected to the computing network, and particularly devices connected to the first circuits of the keystone jacks 100.

The supplementary electric units 80, 90, and 120 can be replaced with other supplementary electric units which are intended to perform similar or different operations. This flexibility allows the operators of the network to choose a supplementary electric unit according to specific needs that may vary from one to another network or components thereof.

The structure of the keystone jacks 100, according to which a supplementary electric unit is a separate detachably attachable unit that allows retrofitting the keystone jacks 100, enables replacing one supplementary electric unit with another supplementary electric unit whilst maintaining connection of the network cable to the termination portion 30 of the keystone jack 100. This replacement is performed by detaching one supplementary electric unit from interfacing unit 60 of the keystone jack 100 and attaching another supplementary electric unit to the interfacing unit 60 of the keystone jack instead of the previous supplementary electric unit. The replacement of the supplementary electric units can be performed, for example, for exchanging an electronic logic of one supplementary electric unit and its electric element with another electronic logic provided by another supplementary electric unit and electric elements thereof. The replacement can also be performed for exchanging a damaged supplementary electric unit with another working (i.e., not damaged) supplementary electric unit.

Figure 5A:
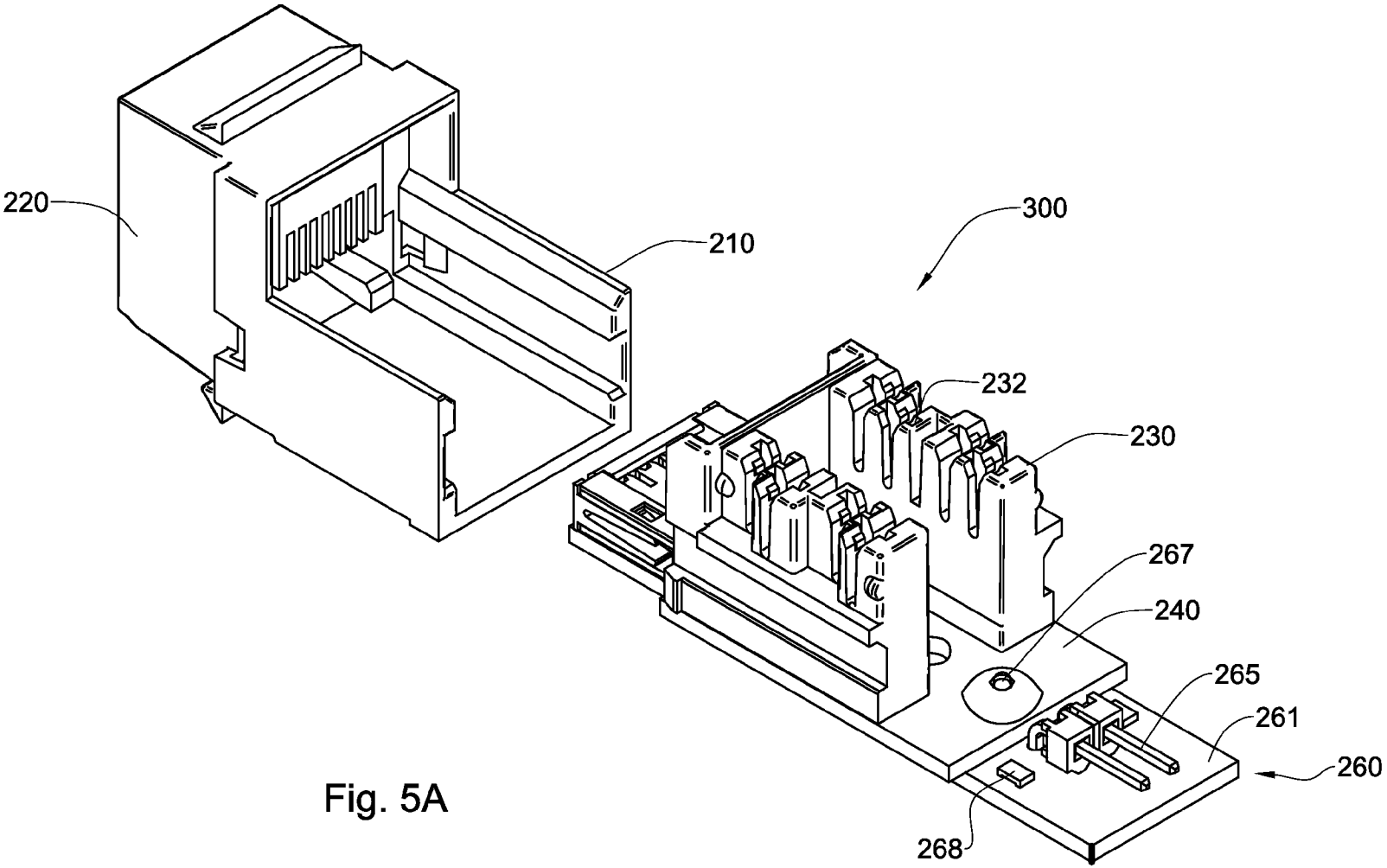
FIG. 5A is a schematic perspective view of a disassembled keystone jack according to another example of the presently disclosed subject matter.
Figure 5B:
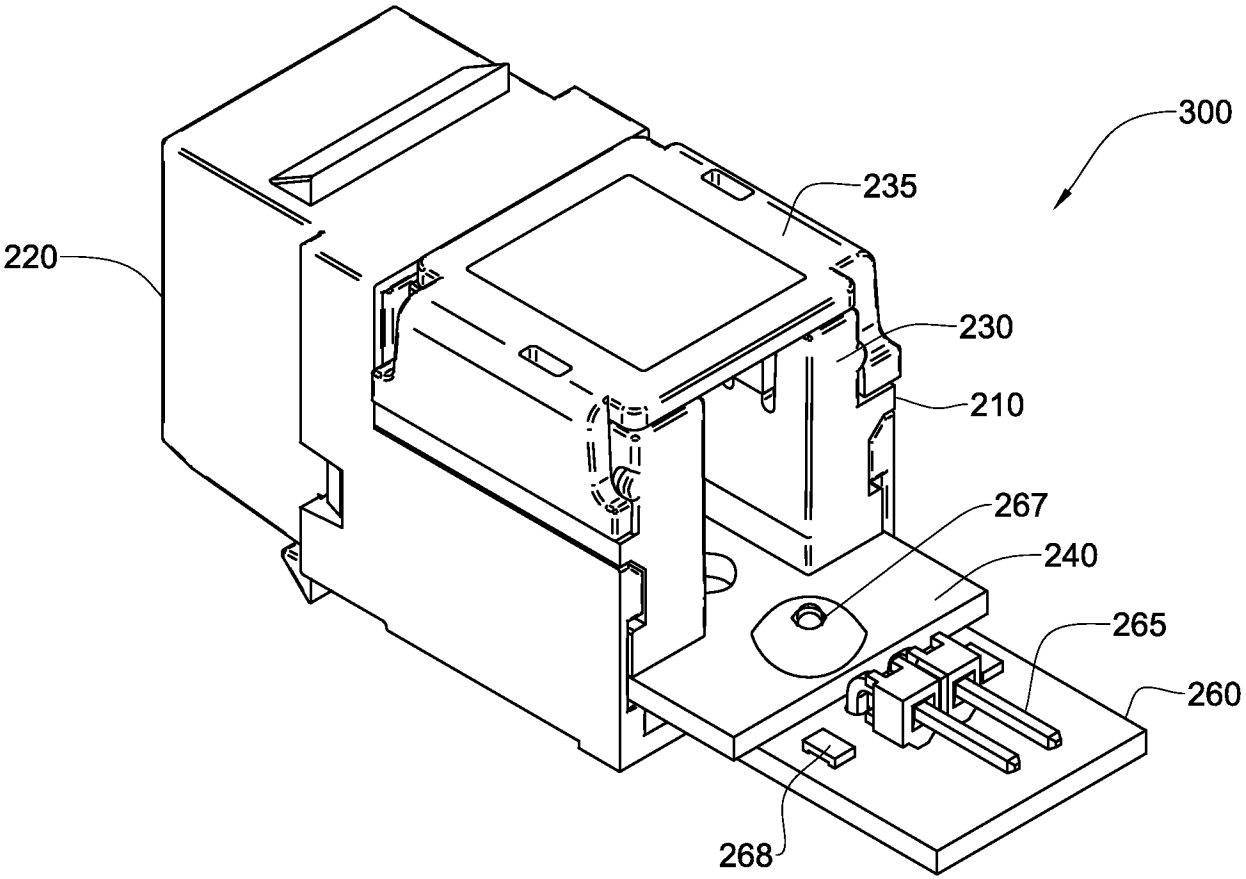
FIG. 5B is a schematic perspective view of an assembled keystone jack according to another example of the presently disclosed subject matter.

Attention is now directed to FIGS. 5A and 5B of the drawings which schematically illustrates a keystone jack 300 according to another example of the presently disclosed subject matter. In FIG. 5A, the keystone jack 300 is presented in its disassembled configuration, and in FIG. 5B, the keystone jack 300 is presented in its assembled configuration. The keystone jack 300 is configured to be used as a port in a wired computing network (not shown). The keystone jack 300 comprises: a housing 210; a plug receptacle 220 formed within the housing 210 and configured to receive a plug connector (not shown) therein; and a termination portion 230 of the housing 210 for connecting wires of a network cable (not shown) thereto. The keystone jack 300 further comprises a first circuit 240 disposed between the plug receptacle 220 and the termination portion 230, and a plurality of conductive terminals (not shown) disposed within the plug receptacle 220 and configured for defining together with the first circuit 240 a communication channel for electrically communicating between the plug receptacle 220 and the termination portion 230. The conductive terminals are connected to orifices formed within the first circuit 240, and the termination portion 230 has a plurality of conductive elements (not shown) which are interfaced with corresponding portions of the first circuit 240 for electrically connecting with the conductive terminals via the first circuit 240.

The termination portion 230 includes a plurality of projecting studs 232, which incorporate conductive IDT terminals. The cable that is connectable to the IDT terminals of the projecting studs 232 includes a plurality of individual wires. This cable can be of an Ethernet standard, containing eight conductive wires that are arranged as twisted pairs, i.e. four pairs of differential signal wires. This cable can lead to a work area outlet or any other network element, component, or port. The individual wires of this cable can be terminated to the IDT terminals by using a termination tool (not shown) that is engaged with the termination portion 230 and then pressed down to force the wires into slots disposed between the projecting studs 232 in which the IDT terminals are held.

When the plug connector is received within the plug receptacle 220, and the network cable is connected to the termination portion 230, a communication channel is established between plug connector and the network cable via the first circuit 240. Following the connection of the network cable to the termination portion 230, the housing 210 is covered with a cover 235. According to the example of FIGS. 5A and 5B, the first circuit 240 is configured only to transfer signals from the plug connector to the network cable, without performing any processing, monitoring or calculations with respect to these signals.

The keystone jack 300 additionally comprises an interfacing unit 260 which is in electric communication with the first circuit 240 and configured for interfacing with a detachably attachable supplementary electric unit (not shown) to provide electrical communication thereof with said at least a portion of the communication channel, and to perform processing of the signals passing therein. As part of this signal processing, the supplementary electric unit can be configured to perform by itself, or in conjunction with a network scanner, or another network element, at least one of the following operations: receive signals relating to operation of the keystone jack 300, to communicate with a network scanner, analyze patching between the keystone jack 300 and ports of one or more other patch panels or work area outlets, monitor electric signals in the communication channel, verify connectivity between the plug connector with a network element connected thereto and the first circuit 240, verify connectivity between the network cable with a network element connected thereto and the first circuit 240, monitor working status of at least one network element connected to the first circuit, and identify the keystone jack 300.

According to other examples, the supplementary electric unit which is connectable to the keystone jack 300 can be configured to perform by itself, or in conjunction with a network scanner, or another network element, at least one of the following operations: identify the location of keystone jacks in a wiring network; verify the normality of each wiring branch of the network and the associate keystone jacks; facilitate a controlled installation of a new system (e.g. computer net) on its wiring network; avoid antenna affect (of open-end wiring receiving and inducting Radio-Frequency interference) in vacant network branches; protect vacant keystone jacks against harms.

The interfacing unit 260 has an interfacing unit circuit 261 on which a plurality of pin terminals 265 are disposed, and which is configured for electrically communicating with the first circuit. The pin terminals 265 are associated with different portions of the communication channel and configured to be received within corresponding receptacles disposed in a connecting unit of the supplementary electric unit for establishing electric communication between at least a portion of the communication channel of the first circuit 240 and the supplementary electric unit. According to different examples, the keystone jack 300 can be used as a port of the following network elements: a patch panel, a cross connect panel, a network switch, and a work area outlet.

As shown in FIGS. 5A and 5B, the interfacing unit circuit 261 is mechanically connected to the first circuit 240 by a connector 267, and is disposed under the first circuit 240. The interfacing unit 260 includes a resistor 268 which is configured to reduce passage of the electric signals from the first circuit 240 to the supplementary electric unit when mounted to the interfacing unit 260.

Attention is now directed to FIGS. 6A, 6B, 7A, 7B, 8A, and 8B of the drawings which schematically illustrate different examples of keystone jacks 400, 500 and 600, respectively, each with two different supplementary electric units which are optionally mountable thereto.

Figure 6A:
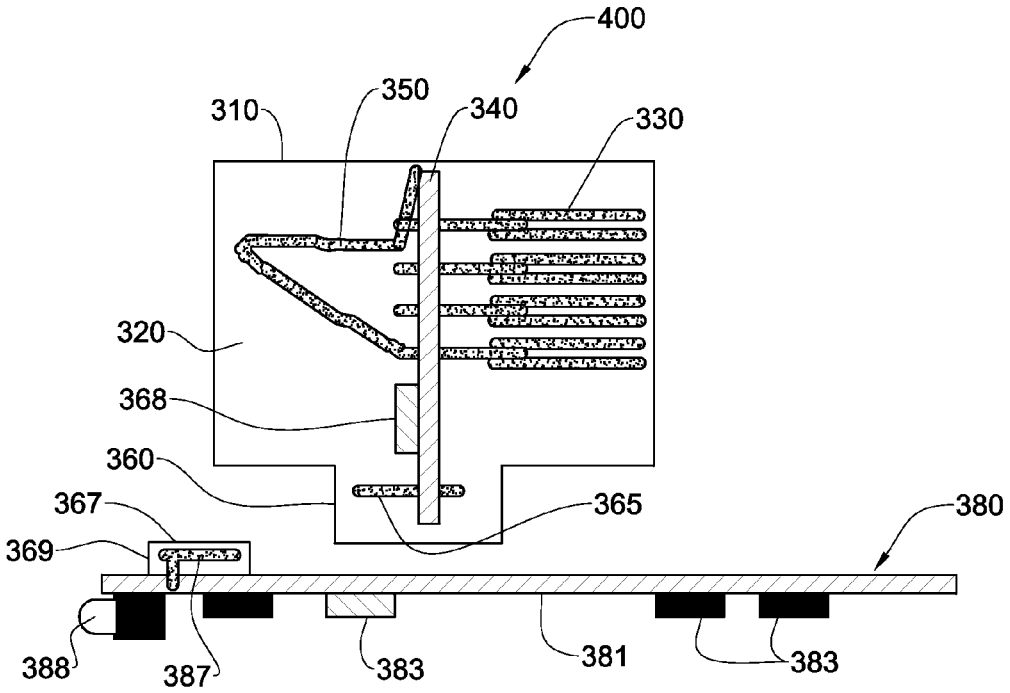
FIGS. 6A and 6B are schematic illustration of a 180°-style keystone jack and two different supplementary electric units mountable thereto.
Figure 6B:
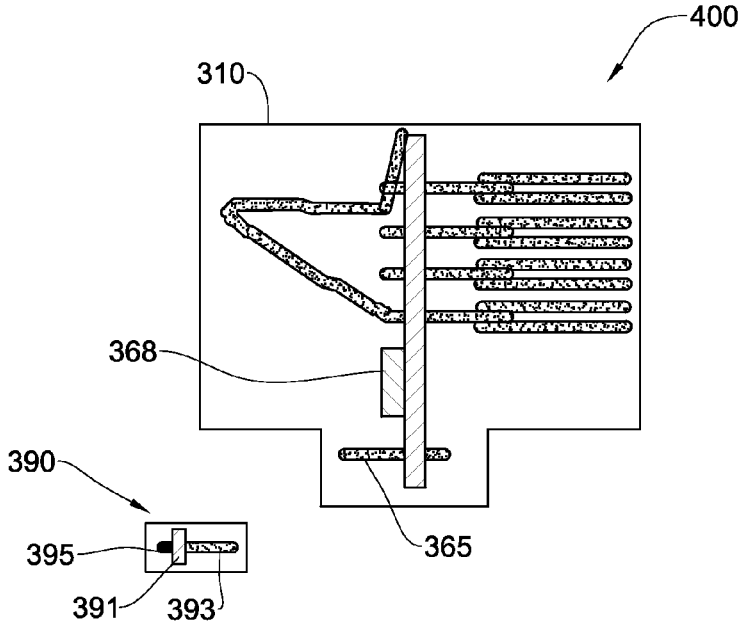

According to the example of FIGS. 6A and 6B, the keystone jack 400 comprises: a housing 310; a plug receptacle 320 formed within the housing 310 and configured to receive a plug connector (not shown) therein; and a termination portion 330 of the housing 310 for connecting wires of a network cable (not shown) thereto. The keystone jack 400 further comprises a first circuit 340 disposed between the plug receptacle 320 and the termination portion 330, and a plurality of conductive terminals 350 disposed within the plug receptacle 320 and configured for defining together with the first circuit 340 a communication channel for electrically communicating between the plug receptacle 320 and the termination portion 330. The conductive terminals 350 are connected to orifices formed within the first circuit 340, and the termination portion 330 has a plurality of conductive elements (not shown) which are interfaced with corresponding portions of the first circuit 340 for electrically connecting with the conductive terminals 350 via the first circuit 340.

The keystone jack 400 is characterized by a 180° configuration, according to which the angle between the plug receptacle 320 and the termination portion 330 is 180°.

When the plug connector is received within the plug receptacle 320, and the network cable is connected to the termination portion 330, a communication channel is established between plug connector and the network cable via the first circuit 340. According to the example of FIGS. 6A and 6B, the first circuit 340 is configured only to transfer signals from the plug connector to the network cable, without performing any processing, monitoring or calculations with respect to these signals.

The keystone jack 400 additionally comprises an interfacing unit 360 which is in electric communication with the first circuit 340 and configured for interfacing with a detachably attachable supplementary electric unit 380 to provide electrical communication thereof with said at least a portion of the communication channel, and to perform processing of the signals passing therein. As part of this signal processing, the supplementary electric unit can be configured to perform by itself, or in conjunction with a network scanner, or another network element, at least one of the following operations: receive signals relating to operation of the keystone jack 300, to communicate with a network scanner, analyze patching between the keystone jack 300 and ports of one or more other patch panels or work area outlets, monitor electric signals in the communication channel, verify connectivity between the plug connector with a network element connected thereto and the first circuit 340, verify connectivity between the network cable with a network element connected thereto and the first circuit 340, monitor working status of at least one network element connected to the first circuit, and identify the keystone jack 400. The interfacing unit 360 has a plurality of pin terminals 365 that are electrically connected to the first circuit 340.

According to FIG. 6A, the pin terminals 365 are associated with different portions of the communication channel and configured to be received within corresponding receptacles 367 disposed in a connecting unit 369 of the supplementary electric unit 380 for establishing electric communication between at least a portion of the communication channel of the first circuit 340 and corresponding connecting pins 387 of the supplementary electric unit 380. The supplementary electric unit 380 comprises a second circuit 381 with a plurality of electric elements 383 mounted thereon. The second circuit 381 is in electric communication with the connecting pins 387 which is configured to contact the pin terminals 365, so that electric communication is created between the first, and the second circuits 340 and 381. The electric elements which are mounted to the second circuit 381, can be for example, the following integrated circuits: a controller, a multiplexer, a logic device, a processor, and any combination thereof.

The first circuit 340 includes a transformer 368 disposed thereon. The second circuit 381, and its electric elements can electrically communicate with the transformer 368 to inject and sense signals relating to signal transition between the communication channel and at least one another network element, or for any other detection and verification purposes.

The second circuit 381 further comprises a LED indicator 388 which is disposed thereon for selectively indicating data related to output of the electric elements 383. The indicator 388 can, for example, indicate proper functioning or connectivity of a network element connected to the first circuit 340 of the keystone jack 400.

According to FIG. 6B, a supplementary electric unit 390 in form of a termination unit is shown. The termination unit 390 includes a second circuit 391, and an electronically sensible element disposed thereon, in form of a resistor 395. The pin terminals 365 are configured to be received within corresponding receptacles 393 disposed in the supplementary electric unit 390 for establishing electric communication between at least a portion of the communication channel of the first circuit 340 and the second circuit 391. The termination unit 390 can be characterized by functionally which is similar to that of the termination unit 90, as explained above.

Figure 7A:
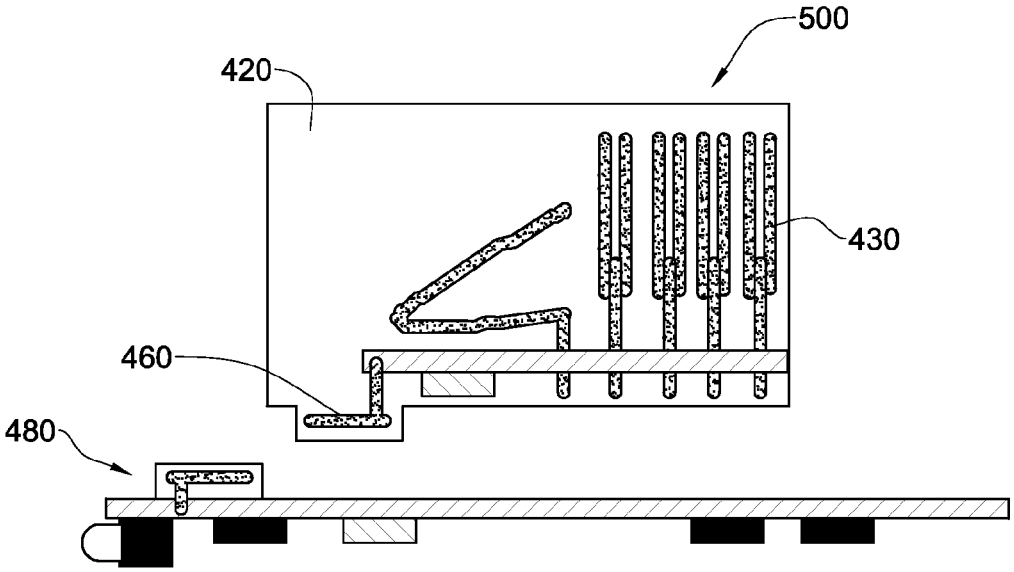
FIGS. 7A and 7B are schematic illustration of a 90°-style keystone jack and two different supplementary electric units mountable thereto.
Figure 7B:
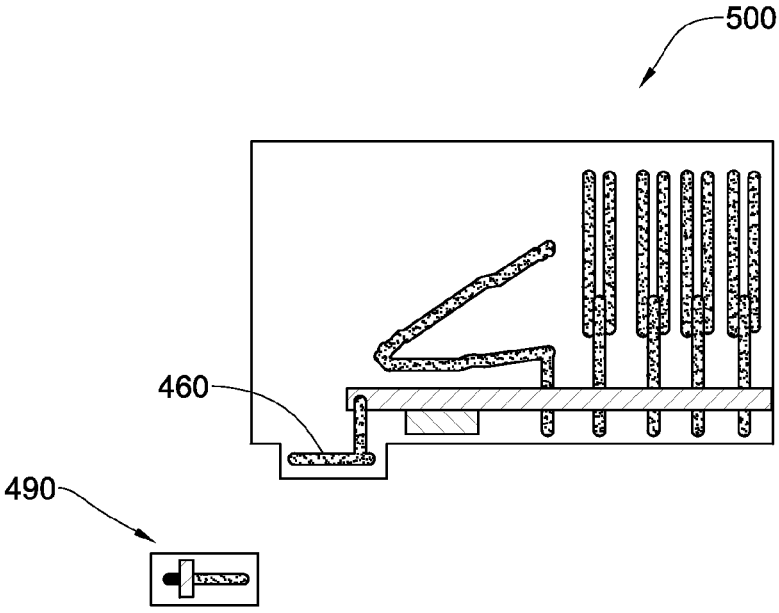

As shown in FIGS. 7A and 7B in which the keystone jack 500 is illustrated, this keystone jack is characterized by a 90° configuration, according to which the angle between a plug receptacle 420 and a termination portion 430 is 90°. Another difference of the keystone jack 500 with respect to keystone jack 400 is in the structure of its interfacing unit 460 and the structure of supplementary electric units 480 and 490 which are connectable thereto. The functionality of the keystone jack 500 and the supplementary electric units 480 and 490 is similar to that of the keystone jack 400 and the supplementary electric units 380 and 390.

Figure 8A:
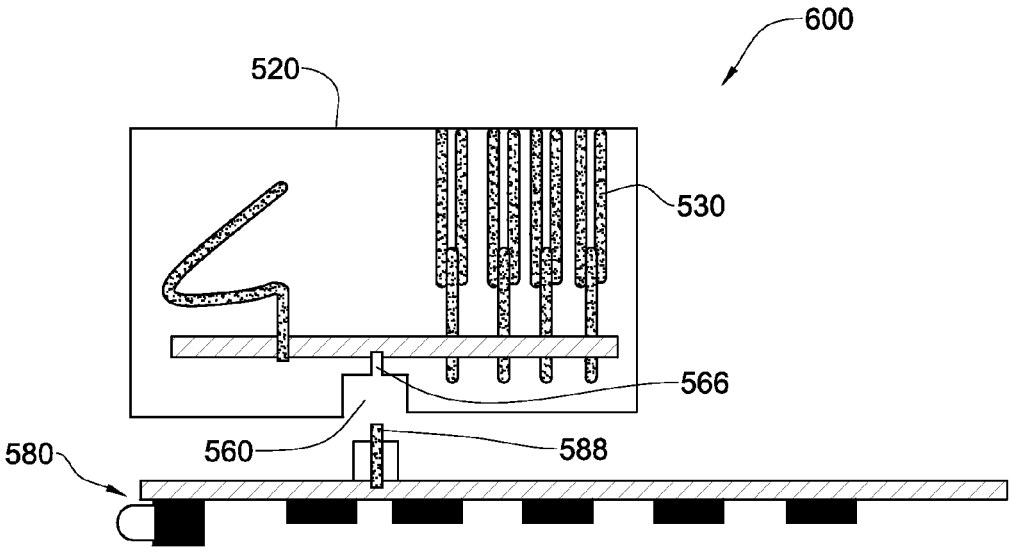
FIGS. 8A and 8B are schematic illustration of a 90°-style keystone jack and two different supplementary electric units mountable thereto.
Figure 8B:
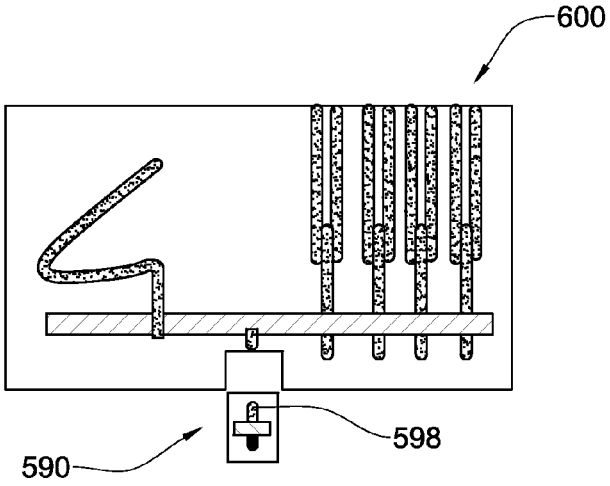
Figure 9A:
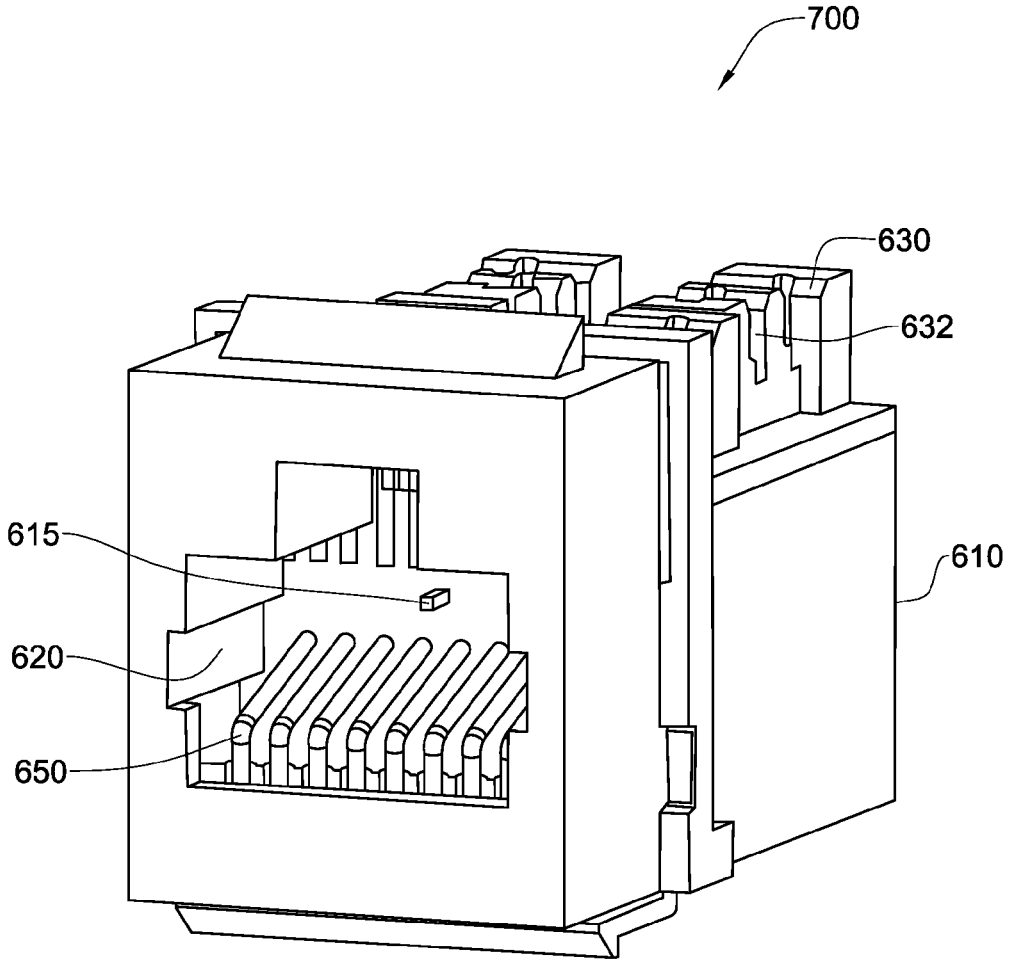
FIGS. 9A to 9D are different schematic perspective views of a keystone jack according to another example of the presently disclosed subject matter.
Figure 9B:
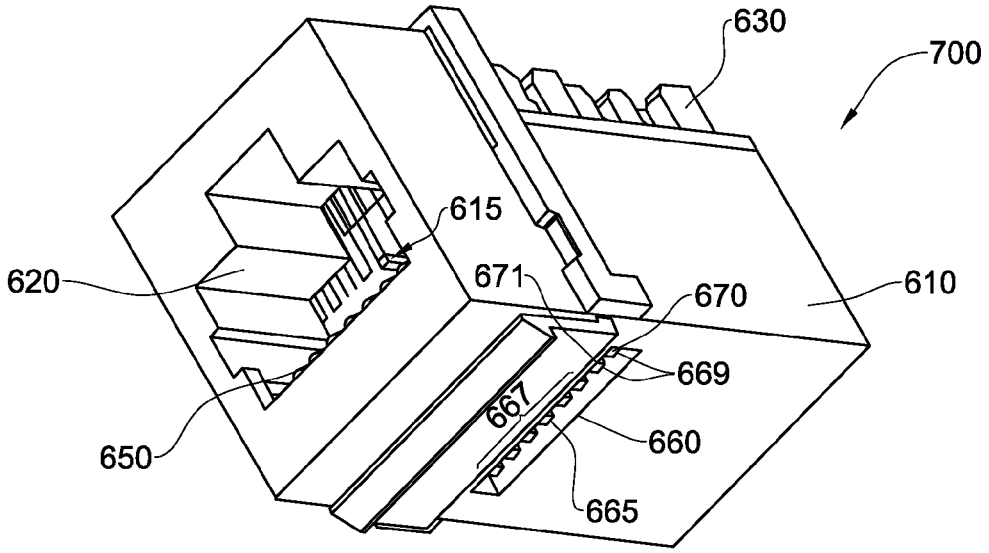
Figure 9C:
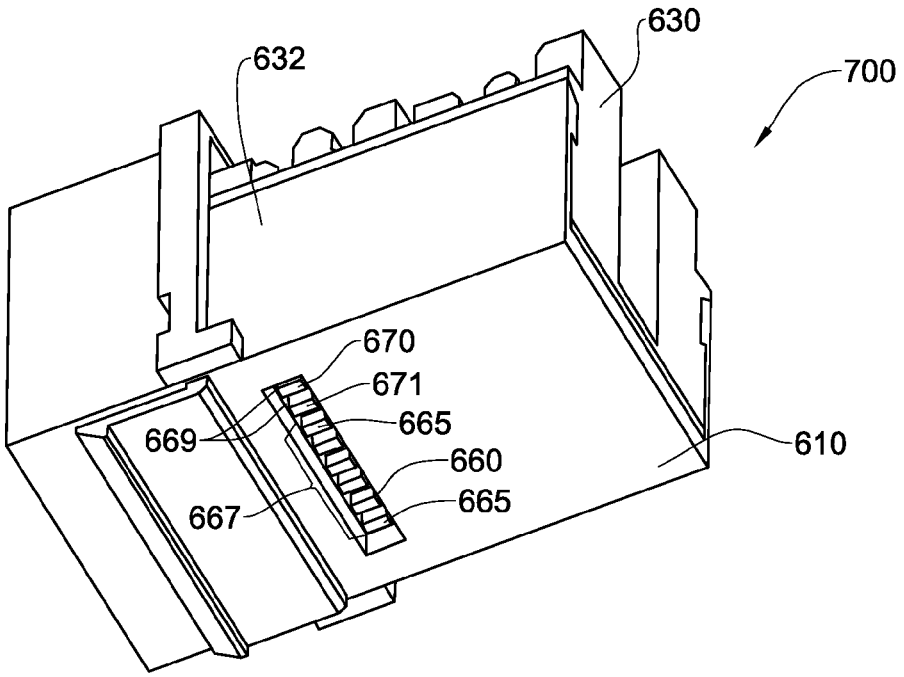
Figure 9D:
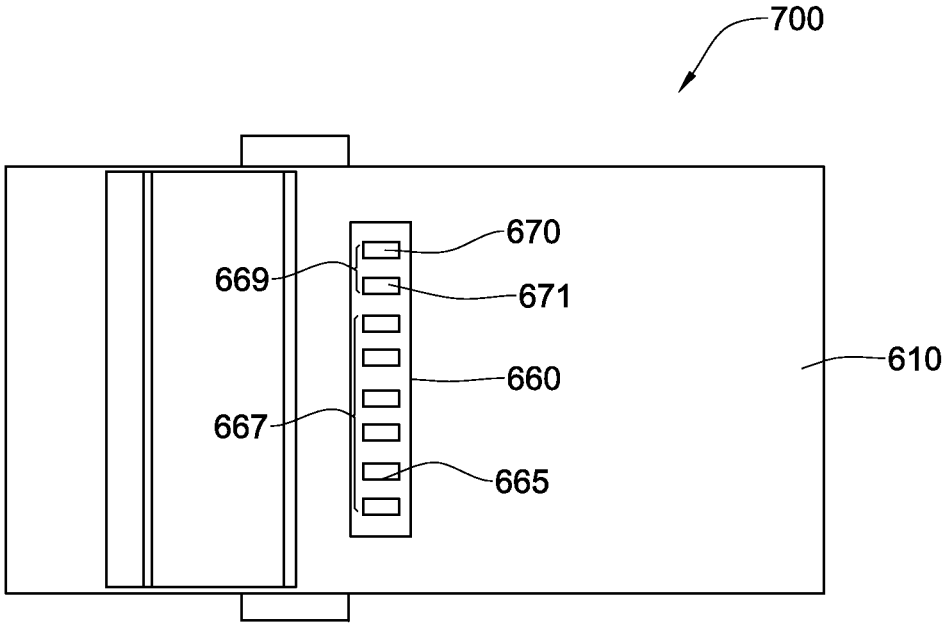

In FIGS. 8A and 8B, in which the keystone jack 600 is illustrated, this keystone jack is characterized by a 90° configuration, according to which the angle between a plug receptacle 520 and a termination portion 530 is 90°. This 90° configuration is similar to that of the keystone jack 500. The difference between the keystone jack 600 and the keystone jack 500 is in the structure of its interfacing unit 560 and the structure of supplementary electric units 580 and 590 which are connectable thereto. According this example, the interfacing unit has a recess 566 into which a corresponding pin 588 of a supplementary electric unit 580 and a pin 598 of a supplementary electric unit 590 is configured to be received for establishing electric communication between the keystone jack the supplementary electric unit.

Reference is now FIGS. 9A to 9D, and FIGS. 10A and 10B, which schematically illustrate another example of a keystone jack 700 with an indicating switch 615 disposed therein, as detailed below.

The keystone jack 700 is configured to be used as a port in a wired computing network (not shown). The keystone jack 700 comprises: a housing 610; a plug receptacle 620 formed within the housing 610 and configured to receive therein a plug connector (not shown) of a patch cord; and a termination portion 630 of the housing 610 for connecting wires of a network cable (not shown) thereto.

The keystone jack 700 further comprises a first circuit 640 (shown in FIGS. 10A and 10B) disposed between the plug receptacle 620 and the termination portion 630, and a plurality of conductive terminals 650 disposed within the plug receptacle 620 and configured for defining together with the first circuit 640 and the termination portion 630 a communication channel for electrically communicating between the plug receptacle 620 and the termination portion 630. The conductive terminals 650 are configured to electrically contact corresponding conductive elements of the plug connector, so as to provide an electric connectivity therewith. In order to establish the communication channel, the conductive terminals 650 and elements of the termination portion 630 are electrically connected to the first circuit 640. As partially shown in FIGS. 10A and 10B, the conductive terminals 650 are held by a supporting element 652, and enter into orifices (not shown) formed within the first circuit 640, so as to establish an electric connectivity with the first circuit 640. The termination portion 630 includes a plurality of projecting studs 632, each of which is electrically connected to the first circuit 640. The projecting studs 632 incorporate conductive insulation displacement technology ("IDT") terminals. The network cable that is connectable to the IDT terminals of the projecting studs 632 includes a plurality of individual wires.

When the plug connector is received within the plug receptacle 620, and the network cable is connected to the termination portion 630, the communication channel between plug connector and the network cable via the first circuit 640 is established.

Figure 10A:
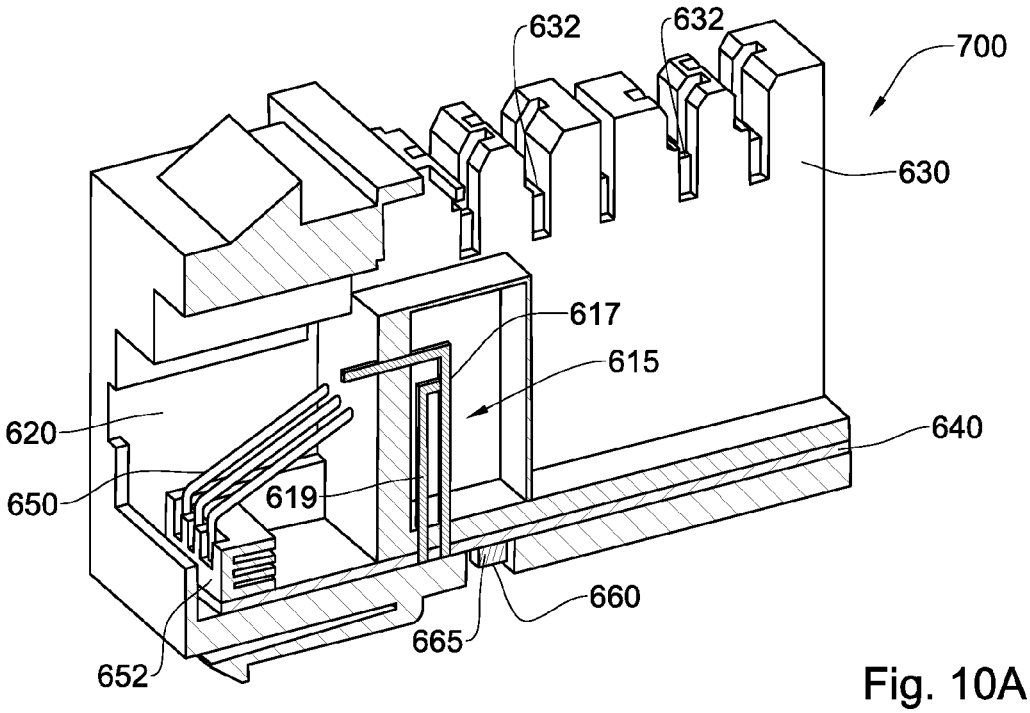
FIGS. 10A and 10B are cross-sectional views of the keystone jack of FIGS. 9A to 9D.
Figure 10B:
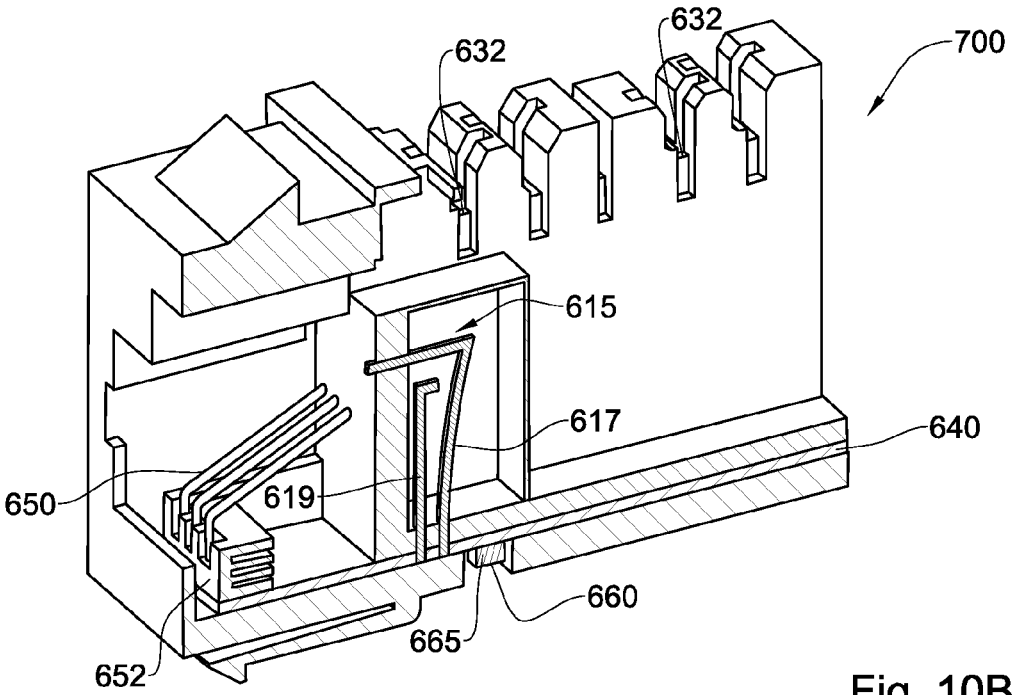

Reference is made to FIGS. 10A and 10B in order to describe the indicating switch 615, and to explain its way of operation. The indicating switch 615 is a mechanical switch which is configured for mechanically indicating plugging of the plug connector within the plug receptacle 620. The indicating switch 615 includes a movable element 617 and a static element 619. FIG. 10A illustrates a closed position of the indicating switch 615, in which no plug connector being received within the plug receptacle 620. In this position, the movable element 617 is in electric contact with the static element 619. FIG. 10B illustrates an opened position of the indicating switch 615, in which a plug connector (which is not shown) being received within the plug receptacle 620. The indicating switch 615 is operatable so that when the plug connector is received within the plug receptacle 620, the movable element 617 changes its position relative to the static element 619, changing thereby the electric connectivity therebetween, to indicate the plugging of the plug connector within the plug receptacle 620. In order to obtain indication regarding the position of the indicating switch 615, the connectivity between the movable element 617 and the static element 619 can be analyzed, for example, by checking the impedance or detection of a short circuit between the movable element 617 and the static element 619.

As it is clearly shown in FIGS. 10A and 10B, the movable element 617 and the static element 619 are seated on the first circuit 640, and electrically connected thereto.

According to the example of FIGS. 9A to 9D, and 10A and 10B, the first circuit 640 is configured only to transfer signals from the plug connector to the network cable and to provide electric indication regarding the plugging of the plug connector within the plug receptacle according to the opened or closed position of the indicating switch 615, without performing any processing, monitoring or calculations with respect to these signals. According to other examples, the first circuit can include electrical elements which may be configured for performing various monitoring and signal processing operations.

The keystone jack 700 additionally comprises an interfacing unit 660 which is in electric communication with the first circuit 640 and which is configured for interfacing with a detachably attachable supplementary electric unit (that can be, for example, one of the supplementary electric units mentioned above) to provide electrical communication thereof with said at least a portion of the communication channel, and to perform processing of the signals passing therein. As part of this signal processing, the supplementary electric unit can be configured to perform by itself, or in conjunction with a network scanner, or another network element, at least one of the following operations: receive signals relating to operation of the keystone jack 700, to communicate with a network scanner, analyze patching between the keystone jack 700 and ports of one or more other patch panels or work area outlets, monitor electric signals in the communication channel, verify connectivity between the plug connector with a network element connected thereto and the first circuit 640, verify connectivity between the network cable with a network element connected thereto and the first circuit 640, monitor working status of at least one network element connected to the first circuit 640, and identify the keystone jack 700. According to the present example, the interfacing unit 660 is separate and distinct from the termination portion 630.

The interfacing unit 660 includes a plurality of pin terminals 665 that are electrically connected to the first circuit 640. The pin terminals 665 are associated with different portions of the communication channel and configured to be received within corresponding receptacles disposed within the supplementary electric unit for establishing electric communication between the first circuit 640 and the supplementary electric unit, so as to allow performance of the above different operations of the supplementary electric unit.

In addition to the above operations which the supplementary electric unit can perform, this unit can also provide information regarding the position of the indicating switch 615 by analyzing the electric conductivity between the movable element 617 and the static element 619.

In contrast to the example of FIGS. 1 to 8 in which each pin terminal is electrically connected to at least one corresponding conductive terminal, in the example of FIGS. 9A to 9D and 10A and 10B, the pin terminals 665 are divided to followings two groups: a first group of pin terminals 667 and a second group of pin terminals 669. The first group 667 is in electric communication with at least a portion of the communication channel, and a second group 669 is in electric communication with the indicating switch 615. In particular, the second group 669 includes a first pin 670 which is in electric communication with the movable element 617 and a second pin 671 which is in electric communication with the static element 619.

By connecting the supplementary electric unit to the interfacing unit 660, the supplementary electric unit can receive electric signals from both, the first group 667 and the second group 669. In other words, by electrically connecting to the first group 667, the supplementary electric unit can receive electric indication regarding the signals which pass in at least a portion of the communication path so to obtain the above detailed information regarding the signals passing therein, and by electrically connecting to the second group 669, the supplementary electric unit can receive electric indication regarding the mechanical plugging of the plug connector within the plug receptacle 620. The indication from the second group 669 is obtained by analyzing the electric conductivity between the first pin 670 and the second pin 671.

According to one example, the electric signals of the second group 669 can be in band with first group 667. In this case, each of the pin terminals of the second group is in electric communication with its corresponding pin terminal of the first group 667, i.e., the first pin 670 is electrically connected with one pin from the first group 667, and the second pin 671 is electrically connected with another pin from the first group 667.

In accordance with this example, in order to obtain indication regarding the plugging of the plug connector within the plug receptacle 620, the supplementary electric unit electrically communicates with the pin terminals of the first group 667 that are electrically connected to the first and the second pins 670 and 671 for measuring the impedance or detecting a short circuit therebetween, and thereby receiving conclusion regarding the plugging of the plug connector within the plug receptacle 620.

According to a particular example, the electric communication between the first group 667 and the second group 669 is provided within the supplementary electric unit. According to another particular example, the electric communication between the first group 667 and the second group 669 is provided within the first circuit 640.

According to another example, the electric signals of the second group 669 can be out of band with first group 667. In this case, each of the pin terminals of the second group 669 is electrically insulated from the pin terminals of the first group 667. In accordance with this example, in order to obtain indication regarding the plugging of the plug connector within the plug receptacle 620, the supplementary electric unit electrically communicates with the pin terminals of the second group 669 and measures the impedance or detects a short circuit therebetween, so as to obtain indication regarding the plugging of the plug connector within the plug receptacle 620.

The invention claimed is:

1. A keystone jack for use as a port in a wired computing network, comprising:

a housing;

a plug receptacle within said housing configured to receive a plug connector therein;

a termination portion of said housing for connecting a network cable thereto;

a first circuit disposed between said plug receptacle and said termination portion;

a plurality of conductive terminals, which are disposed within the plug receptacle and are configured to electrically communicate, together with the first circuit, one or more signal pairs between the plug receptacle and the termination portion; and an interfacing unit, which comprises pin terminals that extend to an outside of the housing, wherein the pin terminals are electrically connected to one or more of the signal pairs communicated between the plug receptacle and the termination portion, for accessing the one or more of the signal pairs by a supplementary electric unit that is detachably attachable to the pin terminals.

2. The keystone jack according to claim 1, wherein the supplementary electric unit comprises at least one second circuit with at least one electric element mounted thereon.

3. The keystone jack according to claim 2, wherein the at least one electric element is at least one integrated circuit.

4. The keystone jack according to claim 1, wherein the pin terminals are configured for connecting with corresponding receptacles of the supplementary electric unit, thereby establishing electric communication between the one or more of the signal pairs and the supplementary electric unit.

5. The keystone jack according to claim 1, further comprising an indicating switch configured for indicating plugging of said plug connector within said plug receptacle.

6. The keystone jack according to claim 5, wherein said indicating switch is in electric communication with the first circuit.

7. The keystone jack according to claim 5, wherein said indicating switch is a mechanical switch having a movable element and a static element; said mechanical switch being operatable so that when the plug connector is received within the plug receptacle, the movable element changes its position relative to the static element, changing thereby the electric connectivity therebetween to indicate the plugging of the plug connector within the plug receptacle.

8. The keystone jack according to claim 5, wherein the interfacing unit comprises a plurality of pin terminals associated with different portions of the communication channel and configured for connecting with corresponding receptacles of the supplementary electric unit, thereby establishing electric communication between the corresponding portions of the communication channel and the supplementary electric unit; and wherein said plurality of pin terminals of said interfacing unit include a first group of pin terminals in electric communication with corresponding portions of the communication channel, and a second group of pin terminals in electric communication with the indicating switch.

9. The keystone jack according to claim 1, wherein said interfacing unit is separate and distinct from the termination portion.

10. A supplementary electric unit configured to interface with a keystone jack according to claim 1.

11. A patch panel comprising at least one keystone jack according to claim 1.

12. A patch panel for use in a wired computing network, the patch panel comprising:

a. a plurality of keystone jacks, each comprising a housing, a plug receptacle within said housing configured to receive a plug connector therein, a termination portion of said housing for connecting a network cable thereto, a first circuit disposed between said plug receptacle and said termination portion, a plurality of conductive terminals, which are disposed within the plug receptacle and are configured to electrically communicate, together with the first circuit, one or more signal pairs between the plug receptacle and the termination portion; and an interfacing unit, which comprises pin terminals that extend to an outside of the housing, wherein the pin terminals are electrically connected to one or more of the signal pairs communicated; and b. at least one supplementary electric unit being interfaced and in electric communication with the corresponding interfacing units of the keystone jacks; said at least one supplementary electric unit being configured for accessing the one or more of the signal pairs of the corresponding keystone jacks via the pin terminals of the interfacing unit.

13. The patch panel according to claim 12, wherein the pin terminals are configured for connecting with corresponding receptacles of the supplementary electric unit, thereby establishing electric communication between the corresponding signal pairs and the supplementary electric unit.

14. The keystone jack according to claim 12, further comprising an indicating switch configured for indicating plugging of said plug connector within said plug receptacle; said indicating switch being in electric communication with the first circuit.

15. The keystone jack according to claim 14, wherein said plurality of pin terminals of said interfacing unit include a first group of pin terminals being in electric communication with corresponding portions of the communication channel, and a second group of pin terminals in electric communication with the indicating switch.

16. A method for retrofitting a wired computing network, the method comprising:

providing a keystone jack comprising a housing, a plug receptacle within said housing configured to receive a plug connector therein, a termination portion of said housing for connecting a network cable thereto, a first circuit disposed between said plug receptacle and said termination portion, a plurality of conductive terminals, which are disposed within the plug receptacle and are configured to electrically communicate, together with the first circuit, one or more signal pairs between the plug receptacle and the termination portion, and an interfacing unit, which comprises pin terminals that extend to an outside of the housing, wherein the pin terminals are electrically connected to one or more of the signal pairs communicated between the plug receptacle and the termination portion, for accessing the one or more of the signal pairs by supplementary electric unit that is detachably attachable to the pin terminals; and replacing said supplementary electric unit with another supplementary electric unit whilst maintaining connection of the network cable to the termination portion.

17. The method according to claim 16, wherein said step of replacing comprises detaching said supplementary electric unit from said interfacing unit and attaching said another supplementary electric unit to said interfacing unit instead of said supplementary electric unit.

18. A method for using a keystone jack in a wired computing network, the method comprising:

obtaining a keystone jack comprising a housing, a plug receptacle within said housing; a termination portion of said housing, a first circuit disposed between said plug receptacle and said termination portion, a plurality of conductive terminals, which are disposed within the plug receptacle and are configured to electrically communicate, together with the first circuit, one or more signal pairs between the plug receptacle and the termination portion, and an interfacing unit, which comprises pin terminals that extend to an outside of the housing, wherein the pin terminals are electrically connected to one or more of the signal pairs communicated between the plug receptacle and the termination portion;

inserting a plug connector within said plug receptacle;

connecting a network cable to the termination portion; and attaching a detachably attachable supplementary electric unit to the interfacing unit, thereby providing the supplementary electric unit access to the one or more of the signal pairs.

19. The method according to claim 18, wherein said keystone jack further comprises an indicating switch, and wherein said method further comprises indicating plugging of the plug connector within the plug receptacle by the indicating switch.

* * * * *